US005845608A

United States Patent [19]

Ban et al.

[11] Patent Number: 5,845,608

[45] Date of Patent: Dec. 8, 1998

[54] VARIABLE CAPACITY TYPE VISCOUS HEATER

[75] Inventors: Takashi Ban; Hidefumi Mori; Kiyoshi Yagi; Tatsuya Hirose; Takahiro Moroi; Sigeru Suzuki; Shintaro Miura; Tsutomu Sato; Fumihiko Kitani, all of Kariya, Japan

[73] Assignee: Kabushiki Kaisha Toyoda Jidoshokki Seisakusho, Kariya, Japan

[21] Appl. No.: 875,433

[22] PCT Filed: Oct. 31, 1996

[86] PCT No.: PCT/JP96/03207

§ 371 Date: Jun. 30, 1997

§ 102(e) Date: Jun. 30, 1997

[87] PCT Pub. No.: WO97/16323

PCT Pub. Date: May 9, 1997

[30] Foreign Application Priority Data

| | | | |
|---|---|---|---|
| Nov. 1, 1995 | [JP] | Japan | 7-285266 |
| Jul. 8, 1996 | [JP] | Japan | 8-178153 |
| Aug. 29, 1996 | [JP] | Japan | 8-229058 |

[51] Int. Cl.[6] ..... F22B 3/06; F28C 3/00

[52] U.S. Cl. ..... 122/26; 126/247

[58] Field of Search ..... 122/26; 126/247

[56] References Cited

U.S. PATENT DOCUMENTS

| | | | |
|---|---|---|---|
| 3,591,079 | 7/1971 | Peters . | |
| 4,285,329 | 8/1981 | Moline . | |
| 4,974,778 | 12/1990 | Bertling | 122/26 |
| 4,993,377 | 2/1991 | Itakura . | |

FOREIGN PATENT DOCUMENTS

| | | |
|---|---|---|
| 03610530 | 4/1990 | European Pat. Off. . |
| 398107 | of 0000 | Japan . |

*Primary Examiner*—Teresa J. Walberg
*Assistant Examiner*—Jiping Lu
*Attorney, Agent, or Firm*—Brooks Haidt Haffner & Delahunty

[57] ABSTRACT

A variable capacity type viscous heater is provided in which the capacity reduction is carried out securely, and which can inhibit a viscous fluid from deteriorating the endurable heat generation even after a long period of service. For instance, it includes a heat-generating chamber, a collector passage, a supply passage, and a control chamber, which are formed therein. The collector passage is communicated with a central region of the heat-generating chamber, and is capable of opening and closing. The supply passage is communicated with a lower region of the heat-generating chamber. The control chamber is communicated with the collector passage and the supply passage. A silicone oil, held in the heat-generating chamber, is collected into the control chamber by the Weissenberg effect by way of the opened collector passage, thereby carrying out the capacity reduction. Whilst, the silicone oil, held in the control chamber, is supplied into the heat-generating chamber by way of the supply passage, thereby carrying out the capacity enlargement.

26 Claims, 30 Drawing Sheets

(A)

(B)

(A)

(B)

(A)

(B)

VARIABLE CAPACITY TYPE VISCOUS HEATER

TECHNICAL FIELD

The present invention relates to a variable capacity type viscous heater in which a viscous fluid is caused to generate heat by shearing. The resulting heat is utilized as a thermal source for heating by carrying out heat exchange with a circulating fluid which circulates in a radiator chamber.

BACKGROUND ART

As a conventional engineering technique, Japanese Unexamined Patent Publication (KOKAI) No. 3-98,107 discloses a variable capacity type viscous heater. In this viscous heater, a front housing and a rear housing are disposed and fastened so as to face with each other, and form a heat-generating chamber and a water jacket therein. The water jacket is disposed around an outer region of the heat-generating chamber. In the water jacket, circulating water is circulated so that it is taken in through a water inlet port, and that it is delivered out to an external heating circuit through a water outlet port. In the front and rear housings, a driving shaft is held rotatably via a bearing apparatus. To the driving shaft, a rotor is fixed so that it can rotate in the heat-generating chamber. A wall surface of the heat-generating chamber and an outer surface of the rotor constitute axial labyrinth grooves which approach to each other. In a space between the wall surface of the heat-generating chamber and the outer surface of the rotor, a viscous fluid, such as a silicone oil, is interposed.

The characteristic arrangements of the viscous heater are as follows: An upper cover and a lower cover, which are provided with a diaphragm therein, are disposed below the front and rear housings. A control chamber is defined by the upper cover and the diaphragm. The heat-generating chamber is communicated with the atmosphere by a through hole which is drilled through at the top end of the front and rear housings, and the heat-generating chamber is also communicated with the control chamber by a communication pipe which is disposed in the upper cover. The diaphragm is capable of adjusting the internal volume of the control chamber by means of a manifold negative pressure, a coiled spring, and the like.

In the viscous heater built into a vehicle heating apparatus, the rotor rotates in the heat-generating chamber when the driving shaft is driven by an engine. Accordingly, the viscous fluid is caused to generate heat by shearing in the space between the wall surface of the heat-generating chamber and the outer surface of the rotor. The thus generated heat is heat-exchanged to the circulating water in the water jacket. The heated circulating water is used at the heating circuit to heat a passenger compartment of a vehicle.

According to the publication, the capacity variation of the viscous heater is effected as follows. For example, when the heating is carried out too strongly, the diaphragm is displaced downward by means of a manifold negative pressure, thereby enlarging the internal volume of the control chamber. Thus, the heat generation is reduced in the space between the wall surface of the heat-generating chamber and the outer surface of the rotor to relieve the heating (i.e., the capacity reduction), because the viscous fluid, held in the heat-generating chamber, is collected into the control chamber. On the contrary, when the heating is carried out too weakly, the diaphragm is displaced upward by an action of an atmospheric pressure adjustment hole and a coil spring, thereby reducing the internal volume of the control chamber.

Thus, the heat generation is increased in the space between the wall surface of the heat-generating chamber and the outer surface of the rotor to intensify the heating (i.e., the capacity enlargement), because the viscous fluid, held in the control chamber, is delivered out into the heat-generating chamber.

However, in the above-described conventional viscous hater, the viscous fluid should be collected into the control chamber by means of its own weight when reducing the capacity, because the control chamber is disposed below the heat-generating chamber. In this instance, it was found difficult for the viscous fluid to move downward when the rotor is kept rotated. In particular, in the viscous heater, it is further difficult for the viscous fluid to move downward, because the wall surface of the heat-generating chamber and the outer surface of the rotor constitute the axial labyrinth grooves which approach to each other. Therefore, in the viscous heater, the capacity is less likely to be reduced when the heating is carried out too strongly, or when the heating is not needed.

Moreover, in the viscous heater, the viscous fluid is collected into the control chamber from the heat-generating chamber, and thereby a negative pressure arises in the heat-generating chamber. The resulting negative pressure is canceled by introducing fresh air via the through hole. Consequently, the viscous fluid contacts with the fresh air every time the capacity is reduced, and is replenished with the water, which is held in the air, at any time. As a result, the degradation by the water is likely to develop in the viscous. In this instance, the endurable heat-generating efficiency of the viscous fluid is deteriorated inevitably after a long period of service.

In addition, in the viscous heater, when the viscous fluid is not collected into the control chamber, and at the same time when the driving shaft is kept rotated at a high revolving speed, the viscous fluid, held in the heat-generating chamber, is heated to elevated temperatures unlimitedly, because the viscous heater is not provided with means for replacing the viscous fluid, held in the heat-generating chamber. Thus, the viscous fluid is degraded beyond its heat-resistant limit. In this instance, the heat generation is dropped after a high-speed operation.

It is therefore an assignment to the present invention to provide a variable capacity type viscous heater in which the capacity reduction is carried out securely, and which can inhibit a viscous fluid from deteriorating the endurable heat generation even after a long period of service or even after a high-speed operation.

SUMMARY OF THE INVENTION

A variable capacity type viscous heater in accordance with a first aspect of the invention comprises:

- a housing in which a heat-generating chamber and a radiator chamber are formed, the radiator chamber neighboring the heat-generating chamber, and circulating a circulating fluid therein;
- a driving shaft held rotatably to the housing by way of a bearing apparatus;
- a rotor disposed in the heat-generating chamber rotatably by the driving shaft; and
- a viscous fluid interposed in a space between a wall surface of the heat-generating chamber and an outer surface of the rotor, and caused to generate heat by rotation of the rotor;

wherein the housing is provided with an operable and closable collector passage formed therein, communicated with the heat-generating chamber, a supply passage formed therein, and communicated with the heat-generating chamber, and a control chamber formed therein, and communicated with the collector passage and the supply passage; whereby capacity reduction is carried out by collecting the viscous fluid, held in the heat-generating chamber, by way of the opened collector passage; and whereby capacity enlargement is carried out by supplying the viscous fluid, held in the control chamber, by way of the supply passage.

Additionally, the control chamber is disposed in the housing, and is communicated with the heat-generating chamber by the collector passage and the supply passage. Accordingly, the viscous fluid, held in the control chamber, is supplied into the heat-generating chamber by way of the supply passage. In this instance, when the collector passage is opened, the heat generation can be reduced in the space between the wall surface of the heat-generating chamber and the outer surface of the rotor to relieve the heating (i.e., the capacity reduction), because the viscous fluid, held in the heat-generating chamber, is collected into the control chamber by way of the collector passage. On the contrary, when the collector passage is closed, the heat generation can be increased in the space between the wall surface of the heat-generating chamber and the outer surface of the rotor to intensify the heating (i.e., the capacity enlargement), because the viscous fluid, held in the heat-generating chamber, is not collected into the control chamber by way of the collector passage. Thus, the capacity reduction and the capacity enlargement can be selected by adjusting the collection amount and the supply amount of the viscous fluid.

Moreover, when the viscous fluid is collected from the heat-generating chamber into the control chamber, or when it is reversely supplied from the control chamber into the heat-generating chamber, there arises no negative pressure which results from the transfer of the viscous fluid, because the sum of the internal volumes of the heat-generating chamber, the collector passage, the supply passage and the control chamber is invariable. Consequently, the viscous fluid is not deteriorated or adversely affected, because it is not brought into contact with newly introduced air, and because it is not replenished with the water, which is held in the air, at any time.

Except for the case where compulsory supplying means is disposed so that the supply passage is permitted to be communicated with a central region of the heat-generating chamber, it is preferred that the supply passage is communicated with an outer peripheral region of the heat-generating chamber. This results from the fact that the viscous fluid, supplied to an outer peripheral region of the heat-generating chamber, is likely to be transferred over the entire region, even to a central region of the heat-generating chamber, by the Weissenberg effect described later. As a result, the heat generation can be increased quickly in the space between the wall surface of the heat-generating chamber and the outer surface of the rotor.

Therefore, in the viscous heater mentioned above, the capacity reduction can be carried out securely, and the endurable heat-generating efficiency can be inhibited from deteriorating even after a long period of service. Moreover, no electromagnetic clutch is not necessarily required when the heating is demanded, or not demanded, because the capacity control can be thus carried out securely. All in all, the viscous heater can realize to reduce a heating apparatus in terms of cost, and to make it lightweight.

In accordance with another aspect of the invention, a variable capacity type viscous heater set forth in claim 2 comprises:

a housing in which a heat-generating chamber and a radiator chamber are formed, the radiator chamber neighboring the heat-generating chamber, and circulating a circulating fluid therein;

a driving shaft held rotatably to the housing by way of a bearing apparatus;

a rotor disposed in the heat-generating chamber rotatably by the driving shaft; and a viscous fluid interposed in a space between a wall surface of the heat-generating chamber and an outer surface of the rotor, and caused to generate heat by rotation of the rotor;

wherein the housing is provided with a collector passage formed therein, and communicated with the heat-generating chamber, an operable and closeable supply passage formed therein, communicated with the heat-generating chamber, and a control chamber formed therein, and communicated with the collector passage and the supply passage; whereby capacity reduction is carried out by collecting the viscous fluid, held in the heat-generating chamber, by way of the collector passage; and whereby capacity enlargement is carried out by supplying the viscous fluid, held in the control chamber, by way of the opened supply passage.

Additionally, the control chamber is disposed in the housing, and is communicated with the heat-generating chamber by the collector passage and the supply passage. Accordingly, the viscous fluid, held in the heat-generating chamber, is collected into the control chamber by way of the collector passage. In this instance, when the supply passage is opened, the heat generation can be increased in the space between the wall surface of the heat-generating chamber and the outer surface of the rotor to intensify the heating (i.e., the capacity enlargement), because the viscous fluid, held in the control chamber, is supplied into the heat-generating chamber by way of the supply passage. On the contrary, when the supply passage is closed, the heat generation can be reduced in the space between the wall surface of the heat-generating chamber and the outer surface of the rotor to relieve the heating (i.e., the capacity reduction), because the viscous fluid, held in the control chamber, is not supplied into the heat-generating chamber by way of the supply passage. Similarly to the viscous heater first mentioned above, the capacity reduction and the capacity enlargement can be selected by adjusting the collection amount and the supply amount of the viscous fluid.

Likewise, in the second mentioned viscous heater set forth in claim 2, the viscous fluid is less likely to be deteriorated in the same manner as the first mentioned viscous heater.

Hence, the second mentioned viscous heater can produce the identical advantages to those produced by the first mentioned viscous heater.

A further variable capacity type viscous heater is characterized in that the collector passage is communicated with a central region of the heat-generating chamber, and the capacity reduction is at least carried out by the Weissenberg effect which results from the viscous fluid transferred by way of the collector passage.

In the further viscous heater, when the rotor is kept rotated, the Weissenberg effect arises in which the viscous fluid is gathered around the axial center against the centrifugal force, because the viscous fluid, held in the heat-generating chamber, is rotated perpendicularly with respect to the liquid surface. It is believed that the Weissenberg effect results from the normal stress effect. As a result, the viscous fluid, held in the heat-generating chamber, can be collected quickly from a central region of the heat-generating chamber into the control chamber by way of the collector passage.

Another variable capacity type viscous heater is characterized in that the collector passage of the variable capacity type viscous heater has a control-chamber-side opening which is disposed on an upper side with respect to a liquid level of the viscous fluid, held in the control chamber, and that the supply passage thereof has a control-chamber-side opening which is disposed on a lower side with respect to the liquid level of the viscous fluid, held in the control chamber.

In third last mentioned viscous heater, the liquid levels of the viscous fluid are equalized by the transfer of the gas and the own weight of the viscous fluid in the heat-generating chamber and the control chamber before starting: namely; before driving the driving shaft. Accordingly, it is possible to start by a small torque, because the amount of the viscous fluid sheared by the rotor is less. As a result, the shock resulting from starting is less.

After starting the driving shaft, the viscous fluid is developed into the heat-generating chamber, thereby increasing the heat generation in the space between the wall surface of the heat-generating chamber and the outer surface of the rotor.

Meanwhile, in the heat-generating chamber, not only the viscous fluid is sheared, but also the gas is mixed as bubbles in the viscous fluid. Hence, when a control-chamber-side opening of the collector passage is positioned above the viscous fluid in the control chamber, the bubbles are likely to move into the control chamber. Moreover, the viscous fluid is likely to be replaced between the heat-generating chamber and the control chamber by means of the own weight of the viscous fluid. In addition, due to the characteristics of the viscous fluid, for instance, due to the influence of extendible viscosity of a viscoelastic fluid especially, the rotor rotating in the heat-generating chamber is likely to take in the viscous fluid, held in the control chamber, into the heat-generating chamber by way of the supply passage. All in all, the capacity reduction and the capacity enlargement can be carried out quickly.

Eventually, the liquid levels of the viscous fluid are equalized by the transfer of the gas and the own weight of the viscous fluid in the heat-generating chamber and the control chamber after terminating the driving shaft to operate.

Note that, in the last mentioned viscous heater, no special gas passage, which is designed to transfer the gas, is not necessarily required.

Also note that, in the viscous heater, the accommodation amount of the viscous fluid can be controlled with ease by simply positioning the liquid level of the viscous fluid, held in the control chamber, above the control-chamber-side-opening of the supply passage.

A modification of the variable capacity type viscous heater is characterized in that the supply passage has a larger communication area than that of the collector passage thereof.

In the last mentioned viscous heater set forth in claim 5, the viscous fluid is developed quickly into the heat-generating chamber immediately after starting, and in the capacity enlargement, because the viscous fluid can be supplied into the heat-generating chamber quickly. Thus, the heat generation can be increased quickly in the space between the wall surface of the heat-generating chamber and the outer surface of the rotor.

A variable capacity type viscous heater in accordance with a further aspect of the invention is characterized in that the supply passage is provided with compulsory supplying means for compulsorily supplying the viscous fluid, held in the control chamber, into the heat-generating chamber.

In the last mentioned viscous heater, the viscous fluid, collected into the control chamber, is supplied compulsorily into the heat-generating chamber by the compulsory supplying means by way of the supply passage. Thus, the heat generation is increased quickly in the space between the wall surface of the heat-generating chamber and the outer surface of the rotor.

Another embodiment of the variable capacity type viscous heater is characterized in that the compulsory supplying means of the variable capacity type viscous heater is a pump which is disposed so as to be rotatable synchronously with the driving shaft, and in which a vortex groove is formed.

In the last mentioned viscous heater, the vortex groove constitutes a simple screw type pump.

Another variable capacity type viscous heater is characterized in that at least a forward-side peripheral portion, with respect to the rotary direction of the rotor, in a heat-generating-chamber-side opening of the collector passage is formed so that gas, held in the heat-generating chamber, is likely to be taken in into the control chamber by the rotating rotor.

In the last mentioned viscous heater, the viscous fluid is developed quickly into the heat-generating chamber immediately after starting, and in the capacity enlargement, because the bubbles are likely to move to the control chamber. Thus, the heat generation is increased quickly in the space between the wall surface of the heat-generating chamber and the outer surface of the rotor. Whilst, the viscous fluid is collected quickly into the control chamber in the capacity reduction, because the bubbles are likely to move to the control chamber so that the viscous fluid is moved smoothly thereto. Thus, the heat generation is decreased quickly in the space between the wall surface of the heat-generating chamber and the outer surface of the rotor.

Yet another variable capacity type viscous heater is characterized in that at least the forward-side peripheral portion, with respect to the rotary direction of the rotor, in the heat-generating-chamber-side opening of the collector passage is subjected to chamfering.

In the last mentioned viscous heater, the bubbles and viscous fluid, held in the heat-generating chamber, are moved smoothly to the collector passage by the chamfering, and eventually into the control chamber thereby.

A further variable capacity type viscous heater is characterized in that the heat-generating-chamber-side opening of the collector passage is formed as an arc shape which has a larger curvature at a forward-side peripheral portion thereof, with respect to the rotary direction of the rotor, than at a rearside peripheral portion thereof, or it is formed linearly.

In the last mentioned viscous heater, the bubbles and viscous fluid, held in the heat-generating chamber, are moved smoothly to the collector passage, and eventually into the control chamber, because they are not subjected to a large contracting force by the opening configuration of the collector passage.

Another variable capacity type viscous heater is characterized in that the supply passage has a distributor passage, which extends toward an outer periphery of the rotor, in the heat-generating chamber.

In the last mentioned viscous heater, the viscous fluid, collected in the control chamber, is supplied to an outer peripheral region of the heat-generating chamber by way of the distributor passage of the supply passage. The viscous fluid, supplied to the outer peripheral region of the heat-generating chamber, is developed over the entire region, even to a central region of the heat-generating chamber, by the Weissenberg effect thereof. Thus, the heat generation is increased quickly in the space between the wall surface of the heat-generating chamber and the outer surface of the rotor.

A variable capacity type viscous heater is characterized in that the distributor passage is formed so that the viscous fluid, held in the control chamber, is likely to be taken in into the heat-generating chamber by the rotating rotor.

In the last mentioned viscous heater, the viscous fluid is developed quickly into the heat-generating chamber, because the viscous fluid is likely to move into the heat-generating chamber immediately after starting, and in the capacity enlargement. Thus, the heat generation is increased quickly in the space between the wall surface of the heat-generating chamber and the outer surface of the rotor.

A variable capacity type viscous heater is characterized in that the distributor passage is a supply groove which is dented in the housing so as to be opened on a heat-generating-chamber side thereof, and which is inclined with respect to a diametric direction of the rotor on a forward side with respect to the rotary direction of the rotor.

A variable capacity type viscous heater is characterized in that the distributor passage is a supply groove which is dented in the housing so as to be opened on a heat-generating-chamber side thereof, and which is curved with respect to a diametric direction of the rotor on a forward side with respect to the rotary direction of the rotor.

A variable capacity type viscous heater is characterized in that the distributor passage is subjected to chamfering at least at a forward-side peripheral portion with respect to the rotary direction of the rotor.

In this viscous heater, the viscous fluid, held in the distributor passage, is moved smoothly to the heat-generating chamber by the chamfering.

A variable capacity type viscous heater is characterized in that the collector passage of the variable capacity type viscous heater is provided with first valve means which opens and closes the collector passage.

In this viscous heater, when the first valve means opens the collector passage, the heating is relieved, because the viscous fluid, held in the heat-generating chamber, is collected into the control chamber by way of the collector passage. On the other hand, when the first valve means closes the collector passage, the heating is intensified, because the first valve means closes the collector passage so that the viscous fluid, held in the heat-generating chamber, is not collected into the control chamber by way of the collector passage.

A variable capacity type viscous heater is characterized in that the first valve means is a flap valve which is disposed in the control chamber, and which deforms to open or close a control-chamber-side opening of the collector passage.

A variable capacity type viscous heater is characterized in that the flap valve is a reed type one which opens the control-chamber-side opening of the collector passage by pressure increment in the heat-generating chamber.

In the last mentioned viscous heater, no external input is required to reduce the capacity, because the capacity reduction can be carried out by pressure increment in the heat-generating chamber, one of the variations of the physical properties in the viscous heater. Accordingly, it is possible to realize the cost reduction in heating apparatus.

A variable capacity type viscous heater is characterized in that the flap valve is a bimetal type one which opens the control-chamber-side opening of the collector passage by temperature increment in the viscous fluid.

In the viscous heater, no external input is required to reduce the capacity, because the capacity reduction can be carried out by temperature increment in the viscous fluid, one of the variations of the physical properties in the viscous heater. Accordingly, it is possible to realize the cost reduction in heating apparatus.

As for a position where the temperature of the viscous fluid is detected, it is possible to employ the control chamber, the collector convexity, or the like. It is possible to open and close the collector passage by the first valve means in accordance with the temperature of the circulating fluid, held in the radiator chamber, not in accordance with the temperature of the viscous fluid.

Let us consider the case where the circulating fluid is not warm yet, but where the temperature of the viscous fluid, held in the heat-generating chamber, is increased. If such is the case, and when the temperature of the viscous fluid is detected in the control chamber which is communicated with the heat-generating chamber, such an arrangement is advantageous, because the temperature of the viscous fluid, held in the heat-generating chamber, can be quickly related to the capacity control.

A variable capacity type viscous heater is characterized in that the first valve means of the variable capacity type viscous heater mentioned above is a rotary valve which is disposed in the control chamber, and which rotates to open or close a control-chamber-side opening of the collector passage.

Note that the rotary valve can open or close the collector passage and the supply passage at the same time, and that it can open or close the collector passage, the supply passage and the gas passage at the same time in certain applications.

A variable capacity type viscous heater characterized in that the control chamber is provided with a bimetal spiral spring disposed therein, and that the rotary valve is rotated by displacement of the bimetal spiral spring which depends on temperature variation of the viscous fluid held in the control chamber.

A variable capacity type viscous heater is characterized in that the first valve means is an adjusting valve which is disposed in the control chamber, and which opens or closes a control-chamber-side opening of the collector passage in accordance with revolving speed of the driving shaft.

In the viscous heater, as revolving speed of the driving shaft increases, the operation of collecting the viscous fluid into the control chamber is started, or the collection amount is enlarged, because the adjusting valve opens the control-chamber-side opening of the collector chamber. Thus, the viscous fluid, held in the heat-generating chamber, can be inhibited from being heated to elevated temperatures, and eventually from being deteriorated. In this instance, the heat generation can be maintained even after a high-speed operation.

A variable capacity type viscous heater is characterized in that the adjusting valve is disposed rotatably and integrally with the driving shaft, and is displaced by centrifugal force resulting from the rotation of the driving shaft.

A variable capacity type viscous heater is characterized in that the supply passage is provided with second valve means which opens and closes the supply passage.

In the viscous heater, when the second valve means opens the supply passage, the heating is intensified, because the viscous fluid, held in the control chamber, is supplied into the heat-generating chamber by way of the supply passage. On the other hand, when the second valve means closes the supply passage, the heating is relieved, because the second valve means closes the supply passage so that the viscous fluid, held in the control chamber, is not supplied into the heat-generating chamber by way of the supply passage.

A variable capacity type viscous heater is characterized in that the second valve means is a flap valve which is disposed in the control chamber, and which deforms to open or close a control-chamber-side opening of the supply passage.

A variable capacity type viscous heater is characterized in that the flap valve is a bimetal type one which opens the control-chamber-side opening of the supply passage by temperature decrement in the viscous fluid.

In the viscous heater, no external input is required to enlarge the capacity, because the capacity enlargement can be carried out by temperature decrement in the viscous fluid, one of the variations of the physical properties in the viscous heater. Accordingly, it is possible to realize the cost reduction in heating apparatus.

As for a position where the temperature of the viscous fluid is detected, it is possible to employ the control chamber, the collector convexity, or the like. It is possible to open and close the supply passage by the second valve means in accordance with the temperature of the circulating fluid, held in the radiator chamber, not in accordance with the temperature of the viscous fluid.

Let us consider the case where the circulating fluid is not cooled yet, but where the temperature of the viscous fluid, held in the heat-generating chamber, is decreased. If such is the case, and when the temperature of the viscous fluid is detected in the control chamber which is communicated with the heat-generating chamber, such an arrangement is advantageous, because the temperature of the viscous fluid, held in the heat-generating chamber, can be quickly related to the capacity control.

A variable capacity type viscous heater is characterized in that the second valve means is a rotary valve which is disposed in the control chamber, and which rotates to open or close a control-chamber-side opening of the supply passage.

Note that the rotary valve can open or close the collector passage and the supply passage at the same time, and that it can open or close the collector passage, the supply passage and the gas passage at the same time in certain applications.

A variable capacity type viscous heater is characterized in that the control chamber is provided with a bimetal spiral spring disposed therein, and that the rotary valve is rotated by displacement of the bimetal spiral spring which depends on temperature variation of the viscous fluid held in the control chamber.

A variable capacity type viscous heater is characterized in that the second valve means is an adjusting valve which is disposed in the control chamber, and which opens or closes a control-chamber-side opening of the supply passage in accordance with revolving speed of the driving shaft.

In the last mentioned viscous heater set forth in claim 29, as revolving speed of the driving shaft increases, the operation of supplying the viscous fluid into the heat-generating chamber is terminated, or the supply amount is decreased, because the adjusting valve closes the control-chamber-side opening of the supply passage. Thus, the viscous fluid, held in the heat-generating chamber, can be inhibited from being heated to elevated temperatures, and eventually from being deteriorated. In this instance, the heat generation can be maintained even after a high-speed operation.

A variable capacity type viscous heater is characterized in that the adjusting valve is disposed rotatably and integrally with the driving shaft, and is displaced by centrifugal force resulting from the rotation of the driving shaft.

A variable capacity type viscous heater is characterized in that the second valve means is a spool valve which opens or closes a control-chamber-side opening of the supply passage by opposition between pressure in the control chamber and atmospheric pressure.

In the viscous heater, as revolving speed of the driving shaft increases, the viscous fluid, held in the control chamber, expands. When the pressure in the control chamber overcomes the atmospheric pressure, the operation of supplying the viscous fluid into the heat-generating chamber is terminated, or the supply amount is decreased, because the spool valve closes the control-chamber-side opening of the supply passage. Thus, the viscous fluid, held in the heat-generating chamber, can be inhibited from being heated to elevated temperatures, and eventually from being deteriorated. In this instance, the heat generation can be maintained even after a high-speed operation.

A variable capacity type viscous heater is characterized in that the opening and closing the supply passage and collector passage are provided with a timing where the collector passage is opened when the supply passage is opened.

In the viscous heater, at the overlapped timing, the viscous fluid, held in the heat-generating chamber, is collected by the Weissenberg effect into the control chamber by way of the collector passage, and simultaneously the viscous fluid, held in the control chamber, is supplied into the heat-generating chamber by way of the supply passage. When there arises such a circulation of the viscous fluid, the heat generation increases in the space between the wall surface of the heat-generating chamber and the outer surface of the rotor, because angular momentum of the rotor can be increased incrementally. Note that the angular momentum is the momentum required for accelerating the viscous fluid of low flow velocity which is supplied from the supply passage into the heat-generating chamber. As a result, it is possible to quickly carry out the capacity variation, and to reduce the temperature fluctuation of the circulating fluid.

A variable capacity type viscous heater is characterized in that the first and second valve means are a rotary valve which is disposed in the control chamber, and which rotates to open or close the control-chamber-side openings of the collector passage and supply passage, and that the rotary valve opens or closes the control-chamber-side openings of the collector passage and supply passage by means of a single arc-shaped through hole.

A variable capacity type viscous heater is characterized in that the housing is provided with a gas passage which communicates the heat-generating chamber with the control chamber.

In the viscous heater, when the viscous fluid is supplied into the heat-generating chamber immediately after starting, and in the capacity enlargement, gases are pushed by the viscous fluid to move from the heat-generating chamber to the control chamber by way of the gas passage. As a result, it is likely to obtain desired heat generation, because gases are virtually not present in the heat-generating chamber. On the other hand, when the viscous fluid is collected into the control chamber immediately after terminating the driving, and in the capacity reduction, the gases are likely to move from the control chamber to the heat-generating chamber by way of the gas passage, because they are pushed by the viscous fluid.

A variable capacity type viscous heater is characterized in that the gas passage communicates an upper side of the heat-generating chamber with an upper side of the control chamber.

In the viscous heater, the own weight of the viscous fluid makes the gases likely to move from the heat-generating chamber to the control chamber by way of the gas passage.

Note that, the term "upper side of the control chamber" means an upper side of the control chamber with respect to the liquid level of the viscous fluid held in the control chamber.

A variable capacity type viscous heater is characterized in that the gas passage is capable of opening and closing.

In the viscous heater, it is possible to inhibit the gases from moving into the heat-generating chamber in the capacity enlargement, and to inhibit the gases from moving into the control chamber in the capacity reduction. As a result, the viscous heater can securely exhibit its capacity.

A variable capacity type viscous heater is characterized in that the gas passage is provided with a third valve means which opens and closes the gas passage.

In the viscous heater, when the third valve means opens the gas passage, the gases, held in the heat-generating chamber, are transferred into the control chamber by way of the gas passage in the capacity enlargement. Accordingly, the heating can be securely intensified. On the other hand, when the third valve means closes the gas passage, the gases, held in the heat-generating chamber, are not transferred into the control chamber by way of the gas passage in the capacity reduction. Consequently, the heating can be securely relieved.

A variable capacity type viscous heater is characterized in that the third valve means is a rotary valve which is disposed in the control chamber, and which rotates to open or close a control-chamber-side opening of the gas passage.

Note that the rotary valve can open or close the collector passage and the supply passage at the same time in certain applications.

A variable capacity type viscous heater is characterized in that the control chamber is provided with a bimetal spiral spring disposed therein, and that the rotary valve is rotated by displacement of the bimetal spiral spring which depends on temperature variation of the viscous fluid held in the control chamber.

In the viscous heater, no external input is required to control the capacity, because the capacity control can be carried out effectively by temperature variation in the viscous fluid, one of the variations of the physical properties in the viscous heater. Accordingly, it is possible to realize the cost reduction in heating apparatus.

As for a position where the temperature of the viscous fluid is detected, it is possible to employ the control chamber, the collector convexity, or the like. It is possible to open and close the gas passage by the third valve means in accordance with the temperature of the circulating fluid, held in the radiator chamber, not in accordance with the temperature of the viscous fluid.

Let us consider the case where the circulating fluid is not warm yet, but where the temperature of the viscous fluid, held in the heat-generating chamber, is increased. If such is the case, and when the temperature of the viscous fluid is detected in the control chamber which is communicated with the heat-generating chamber, such an arrangement is advantageous, because the temperature of the viscous fluid, held in the heat-generating chamber, can be quickly related to the capacity control.

A variable capacity type viscous heater is characterized in that the rotary valve is formed as a plate shape.

In the viscous heater, the plate-shaped rotary valve reduces an axial length of the viscous heater.

A variable capacity type viscous heater is characterized in that the rotary valve is pressed by urging means in a direction so as to close at least one of the control-chamber-side openings of the collector passage, the supply passage and the gas passage.

In the viscous heater, a coned disk spring, a coil spring, rubber, etc., can be employed as the urging means. When a coned disk spring is employed as the urging means, an axial length of the viscous heater is reduced while the rotary valve can open or close the collector passage, and the like.

A variable capacity type viscous heater is characterized in that the rotor is formed as a flat plate shape.

In the viscous heater, the viscous fluid is made to exhibit have a liquid level of a large surface area in a direction perpendicularly to an axial center line of the viscous heater by employing the rotor having such a configuration. As a result, there securely arises the Weissenberg effect.

A variable capacity type viscous heater is characterized in that the rotor is provided with a central aperture which is drilled through in a central region of the rotor.

In the viscous heater, the viscous fluid, placed between a front wall surface of the heat-generating chamber and a front side surface of the rotor, is likely to be collected into the control chamber by way of the central aperture in the capacity reduction. On the contrary, the viscous fluid, held in the control chamber, is likely to be sent out between the front wall surface of the heat-generating chamber and the front side surface of the rotor in the capacity enlargement.

Note that the first, second and third valve means can be materialized by identical means.

BRIEF DESCRIPTION OF DRAWINGS

FIG. 17 is concerned with the variable capacity type viscous heater of the Fourth Preferred Embodiment, wherein:

FIG. 17(A) is an enlarged plan view which is viewed on a heat-generating chamber side of a first collector hole; and FIG. 17(B) is an enlarged cross-sectional view around the first collector hole, etc.

FIG. 19 is concerned with a variable capacity type viscous heater of a comparative example, wherein:

FIG. 19(A) is an enlarged plan view which is viewed on a heat-generating chamber side of a first collector hole; and FIG. 19(B) is an enlarged cross-sectional view around the first collector hole, etc.

FIG. 43 is concerned with the variable capacity type viscous heater of the Fourteenth Preferred Embodiment, wherein:

FIG. 43(A) is a model diagram which illustrates an enclosed space; and

FIG. 43(B) is a model diagram which illustrates a spool chamber.

DETAILED DESCRIPTION OF THE INVENTION

First through Fourteenth Preferred Embodiments embodying the present invention will be hereinafter described with reference to the drawings.

First Preferred Embodiment

Figure 1:
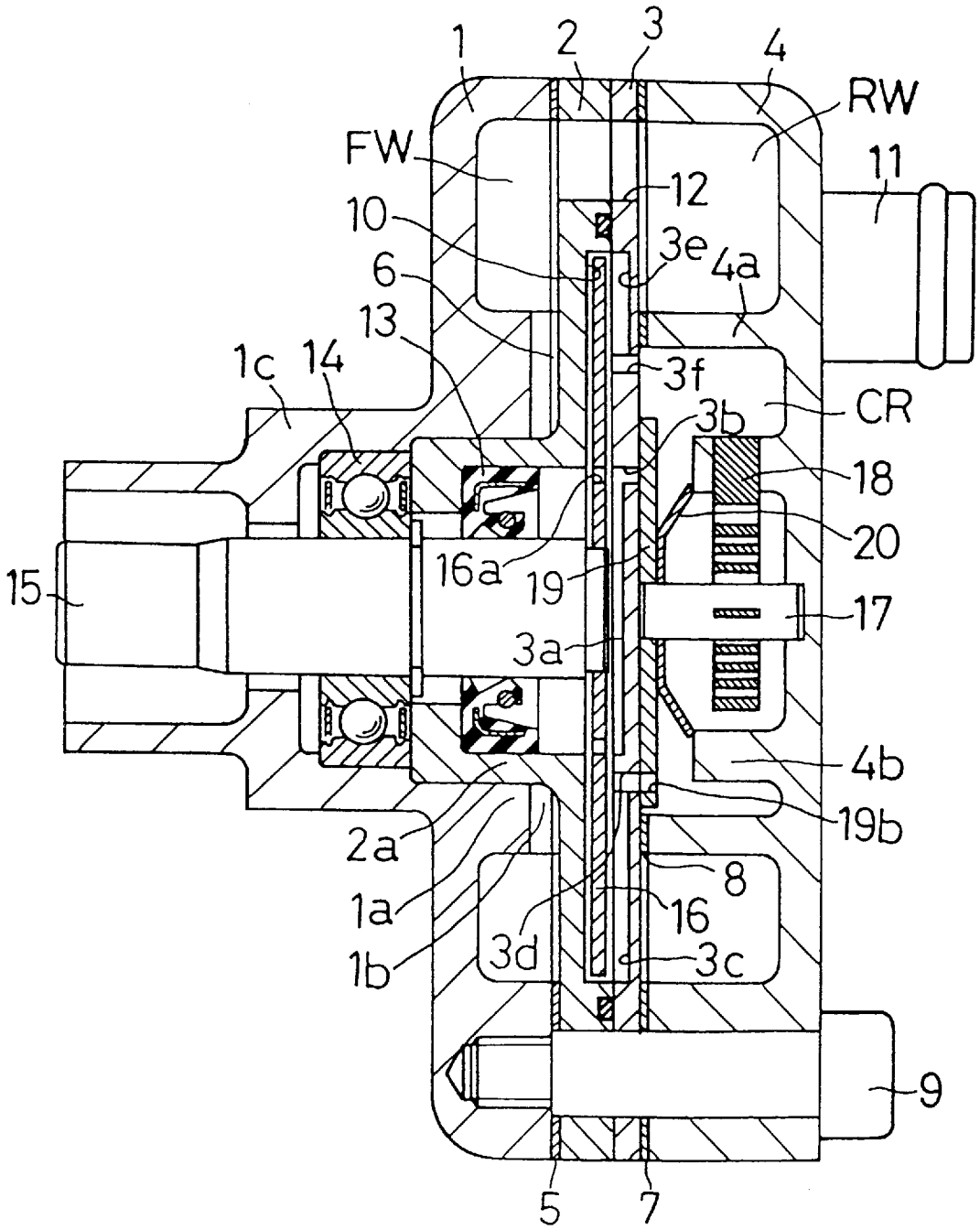
FIG. 1 is a vertical cross-sectional view of a variable capacity type viscous heater of a First Preferred Embodiment.

As illustrated in FIG. 1, in the viscous heater, a front housing body 1, a front plate 2, a rear plate 3 and a rear housing body 4 are overlapped and fastened by a plurality of through bolts 9 with gaskets 5 and 6 interposed between the front housing body 1 and the front plate 2, and with gaskets 7 and 8 interposed between the rear plate 3 and the rear housing body 4. Here, the front housing body 1, the front plate 2, the rear plate 3 and the rear housing body 4 constitute a housing.

Figure 3:
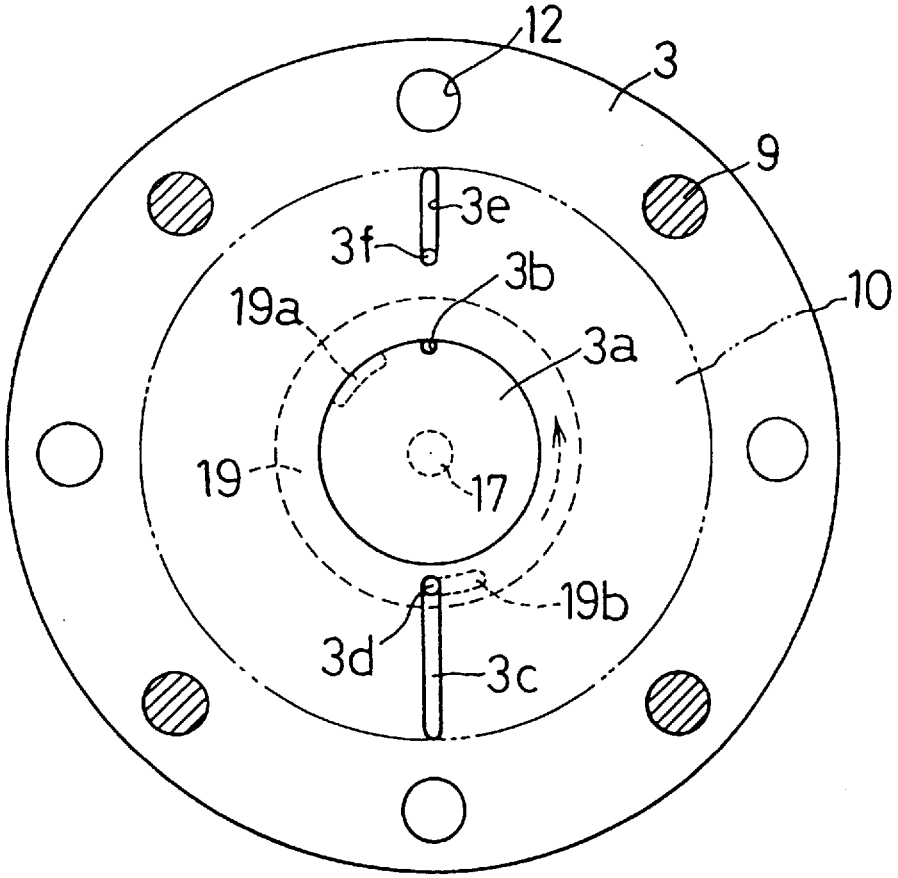
FIG. 3 is concerned with a rear plate, etc., of the variable capacity type viscous heater of the First Preferred Embodiment, and is a plan view in the capacity enlargement, plan view which is viewed on a front side.
Figure 4:
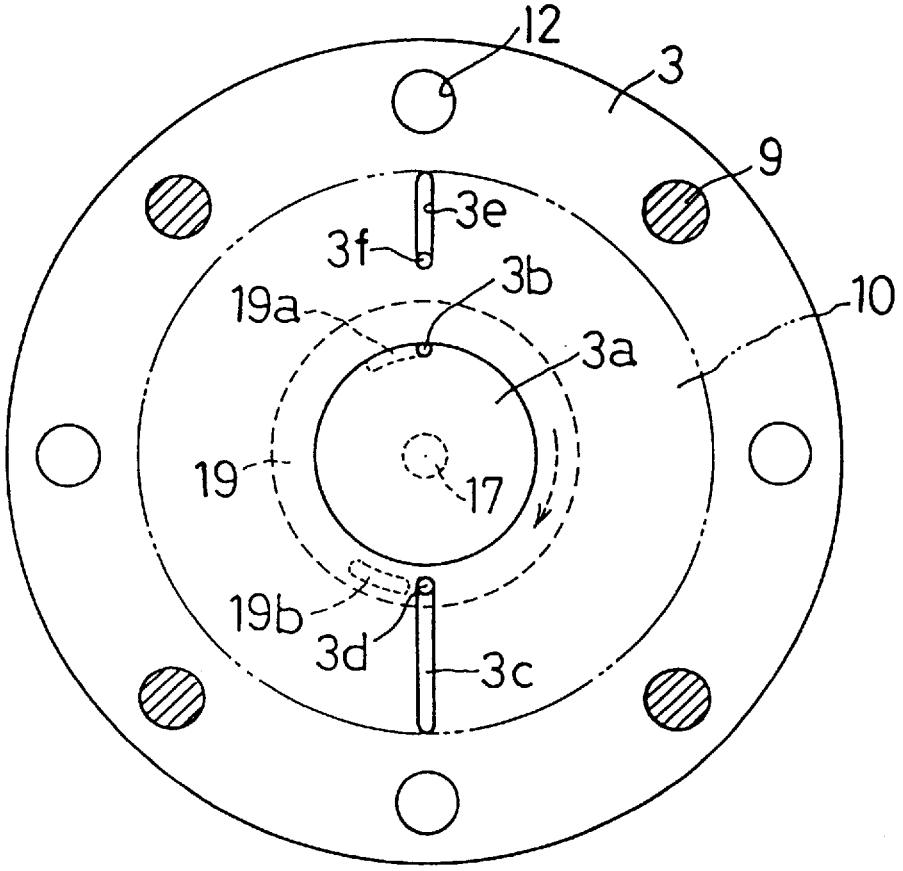
FIG. 4 is concerned with the rear plate, etc., of the variable capacity type viscous heater of the First Preferred Embodiment, and is a plan view in the capacity reduction, plan view which is viewed on a front side.

In a rear-end surface of the front plate 2, a concavity is dented flatly, and forms a heat-generating chamber 10 together with a flat front-end surface of the rear plate 3. Further, as also illustrated in FIGS. 3 and 4, in a front-end surface of the rear plate 3, a collector concavity 3*a* is dented so as to face a central region of the heat-generating chamber 10. Note that, at an outside position in the collector concavity 3*a*, a first collector hole 3*b* is drilled through to a rear-end surface of the rear plate 3. Furthermore, in a front-end surface of the rear plate 3, a supply groove 3*c* is formed so as to extend from a bottom-side exterior of the collector concavity 3*a* to a bottom-side outer region of the heat-generating chamber 10. The supply groove 3*c* works as the distributor passage. Note that, at an inside position in the supply passage 3*c*, a first supply hole 3*d* is also drilled through to a rear-end surface of the rear plate 3. The supply groove 3*c* and the first supply hole 3*d* are designed to have a larger width or diameter than that of the collector concavity 3*a* and the first collector hole 3*b*, and thereby they readily supply a silicone oil, works as the viscous fluid, to the heat-generating chamber 10. Note that the supply groove 3*c* can preferably be formed longer than the position which corresponds to a rotor 16 described later. Moreover, in a front-end surface of the rear plate 3, a gas groove 3*e* is extended from a top-side exterior of the collector concavity 3*a* to a top-side outer region of the heat-generating chamber 10. The gas groove 3*e* constitutes part of the gas passage. Note that, at an inner side position in the gas groove 3*e*, a gas hole 3*f* is also drilled through to a rear-end surface of the rear plate 3. The gas hole 3*f* constitutes the rest of the gas passage.

As illustrated in FIG. 1, an inner surface of the front housing body 1 and a front-end surface of the front plate 2 form a front water jacket FW. The front water jacket FW works as the front radiator chamber neighboring in front of the heat-generating chamber 10. Whilst, on the rear housing body 4, a first rib 4*a* is protruded like a ring. The first rib 4*a* is brought into contact with the gasket 8. A rear-end surface of the rear plate 3 and an inner surface of the rear housing body 4, which is disposed outside the first rib 4*a*, form a rear water jacket RW. The rear water jacket RW works as the rear radiator chamber neighboring in rear of the heat-generating chamber 10. In addition, a rear-end surface of the rear plate 3 and an inner surface of the rear housing body 4, which is disposed inside with respect to the first rib 4*a*, form a control chamber CR which is communicated with the collector concavity 3*a*, the first supply hole 3*d* and the gas hole 3*f*.

In a rear surface of the rear housing body 4, a water inlet port 11 and a water outlet port (not shown) are formed next to each other. The water inlet port 11 and the water outlet port are communicated with the rear water jacket RW. Moreover, in the rear plate 3 and front plate 2, a plurality of water passages 12 are drilled through at equal intervals between the through bolts 9. The front water jacket FW and the rear water jacket RW are communicated with each other by the water passages 12.

Figure 2:
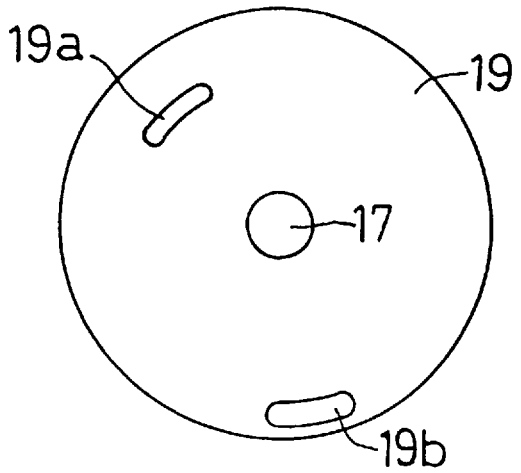
FIG. 2 is concerned with a rotary valve of the variable capacity type viscous heater of the First Preferred Embodiment, and is a plan view which is viewed on a front side.

In the control chamber CR disposed in the rear housing body 4, a second rib 4*b* is protruded like a ring. At the center of the second rib 4*b*, a valve shaft 17 is held rotatably. The second rib 4*b* is engaged with the outer end of a bimetal spiral spring 18, which works as a temperature sensitive actuator. The valve shaft 17 is engaged with the internal end of the bimetal spiral spring 18. Depending on whether a set heating temperature is too high or too low, a predetermined temperature is designed for displacing the bimetal spiral spring 18. Further, a disk-shaped rotary valve 19 is fixed at the front end of the valve shaft 17, and works as the first and second valve means independently. The rotary valve 19 is pressed by a coned disk spring 20 in a direction so as to close the openings of the first collector hole 3*b* and the first supply hole 3*d* on the side of the control chamber CR. The coned disk spring 20 is seated on a front-end surface of the second rib 4*b*, and works as the urging means. As also illustrated in FIG. 2, in the rotary valve 19, an arc-shaped second collector hole 19*a* and an arc-shaped second supply hole 19*b* are drilled through. Depending on the rotary angle of the rotary valve 19, the second collector hole 19*a* and the second supply hole 19*b* can be communicated with the first collector hole 3*b* or the first supply hole 3*d*. Note that the second supply hole 19*b* is designed to have a larger diameter than that of the second collector hole 19*a* so as to readily supply the silicone oil into the heat-generating chamber 10. Thus, the collector concavity 3*a*, the first collector hole 3*d* and the second collector hole 19*a* constitute the collector passage. Whilst, the supply groove 3*c*, the first supply hole 3*d* and the second supply hole 19*b* constitute the supply passage. With these arrangements of the viscous heater, the collector concavity 3*a*, etc., as well as the supply groove 3*c*, etc., can be opened and closed, and simultaneously the axial length of the viscous heater can be reduced.

Moreover, as illustrated in FIG. 1, on the rear plate 2, a boss 2*a* is protruded to extend forwardly in an axial direction. In the boss 2*a*, a shaft-sealing apparatus 13 is disposed so as to neighbor the heat-generating chamber 10. In the front housing body 1, an inner boss 1*a* is protruded to extend in an axial direction to the side of the heat-generating chamber 10. In the inner boss 1*a*, a plurality of openings 1*b* are drilled through on the side of the shaft-sealing apparatus 13. Accordingly, the front water jacket FW is formed adjacent to the shaft-sealing apparatus 13 by leaving a margin of the thickness of the boss 2*a* formed on the front plate 2. In addition, on the front housing body 1, an outer boss 1*c* is protruded to extend forwardly in an axial direction. In the outer boss 1*c*, a bearing apparatus 14 is disposed. By way of the shaft-sealing apparatus 13 and the bearing apparatus 14, a driving shaft 15 is held rotatably. At the trailing end of the driving shaft 15, a plate-shaped rotor 16 is press-fitted so that it can rotate in the heat-generating chamber 10. A silicone oil is interposed in the space between the wall surface of the heat-generating chamber 10 and the outer surface of the rotor 16. The silicone oil works as the viscous fluid. Note that the silicone oil is also held in the control chamber CR to such an extent that it usually immerses most of the bimetal spiral spring 18. However, inevitable air resides more or less, in addition to the silicone oil held in the heat-generating chamber 10, the collector concavity 3*a*, etc., the supply groove 3*c*, etc., and the control chamber CR. Note that the inevitable air results from the assembly operation of the viscous heater. In a central region of the rotor 16, a plurality of central apertures 16*a* are drilled through longitudinally. At the leading end of the driving shaft 15, a pulley (not shown) is fixed. The pulley is rotated by a vehicle engine via a belt.

In the viscous heater built-into a vehicle heating apparatus, the rotor 16 is rotated in the heat-generating chamber 10 when the driving shaft 15, illustrated in FIG. 1, is driven by the engine. Accordingly, the silicone oil is sheared in the space between the wall surface of the heat-generating chamber 10 and the outer surface of the rotor 16, thereby generating heat. The resulting heat is heat-exchanged to the circulating water flowing in the front and rear water jacket FW, RW, and the thus heated circulating water is used for heating a passenger compartment of a vehicle with the heating circuit.

In the mean time, when the rotor 16 is kept rotated, the silicone oil, held in the heat-generating chamber 10, tries to gather in the central region by the Weissenberg effect. In this instance, the silicone oil exhibits a liquid level of a large surface area perpendicularly to the axial center of the viscous heater, because the heat-generating chamber 10 and the rotor 16 having the above-described configurations are employed in the viscous heater. Consequently, the Weissenberg effect arises securely.

Figure 5:
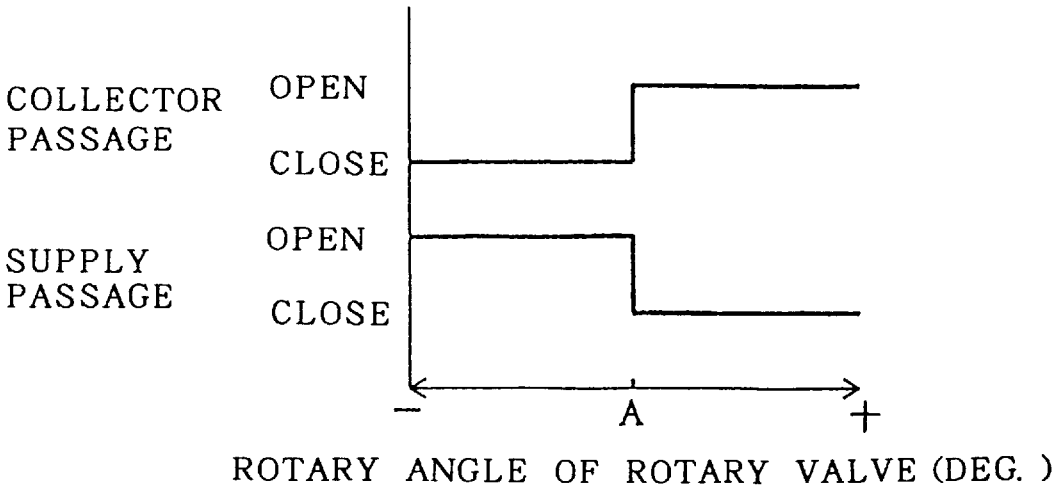
FIG. 5 is concerned with the variable capacity type viscous heater of the First Preferred Embodiment, and is a timing chart which illustrates the relationship between the opening and closing of a collector passage and a supply passage and the rotary angle of the rotary valve.
Figure 6:
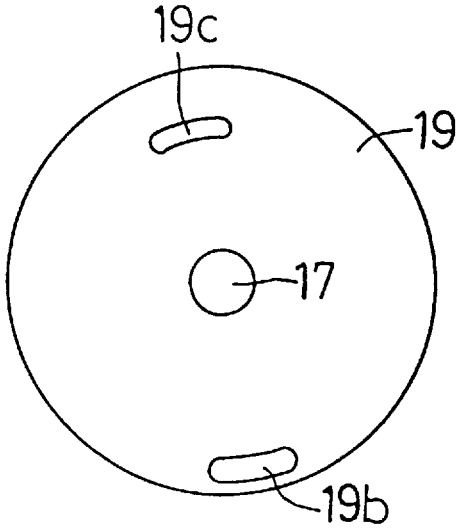
FIG. 6 is concerned with a rotary valve of a variable capacity type viscous heater of a Second Preferred Embodiment, and is a plan view which is viewed on a front side.

In operation, the heating is carried out too weakly when the temperature of the silicone oil, held in the control chamber CR, is low. Accordingly, as illustrated in FIG. 3, the bimetal spiral spring 18 rotates the rotary valve 19 counter-clockwise in the drawing by way of the valve shaft 17. In this instance, the first collector hole 3*b* and the second collector hole 19*a* are not communicated with each other, but the first supply hole 3*d* and the second supply hole 19*b* are communicated with each other. Hence, as designated at a rotary angle of −A° in FIG. 5, the collector concavity 3*a*, etc., are closed in the control chamber CR, and simultaneously the supply groove 3*c*, etc., are opened into the control chamber CR. Note that FIG. 5 shows the operational graph schematically, and that FIGS. 10, 15, 29, 33 and 37 likewise show the operational graph schematically. As a result, the silicone oil, held in the heat-generating chamber 10, is not supplied into the control chamber CR by way of the collector concavity 3*a*, the first collector hole 3*b* and the second collector hole 19*a*. Whilst, the silicone oil, held in the control chamber CR, is supplied into the heat-generating chamber 10 by way of the second supply hole 19*b*, the first supply hole 3*d* and the supply groove 3*c*. In this instance, as can be appreciated from FIG. 1, the silicone oil, held in the control chamber CR, is readily delivered out into the space between the front wall surface of the heat-generating chamber 10 and the front side surface of the rotor 16 by way of the central apertures 16*a*. When the silicone oil is supplied into the space between the wall surface of the heat-generating chamber 10 and the outer surface of the rotor 16, the inevitable air is pushed by the silicone oil to move from the upper side of the heat-generating chamber 10 into the control chamber CR by way of the gas groove 3*e* and the gas hole 3*f*. Thus, the bubbles scarcely exist in the space between the wall surface of the heat-generating chamber 10 and the outer surface of the rotor 16. All in all, the heat generation is increased (i.e., the capacity enlargement) in the space between the wall surface of the heat-generating chamber 10 and the outer surface of the rotor 16, thereby intensifying the heating.

On the other hand, the heating is carried out too strongly when the temperature of the silicone oil, held in the control chamber CR, is high. Accordingly, as illustrated in FIG. 4, the bimetal spiral spring 18 rotates the rotary valve 19 slightly clockwise in the drawing by way of the valve shaft 17. Thus, the first collector hole 3*b* and the second collector hole 19*a* are communicated with each other, and simultaneously the first supply hole 3*d* and the second supply hole 19*b* are not communicated with each other. Specifically, as designated at a rotary angle of +A° in FIG. 5, the collector concavity 3*a*, etc., are opened into the control chamber CR, and simultaneously the supply groove 3*c*, etc., are closed in the control chamber CR. As a result, the silicone oil, held in the heat-generating chamber 10, is collected into the control chamber CR by way of the collector concavity 3*a*, the first collector hole 3*b* and the second collector hole 19*a*. In this instance, as can be appreciated from FIG. 1, the silicone oil, held between the front wall surface of the heat-generating chamber 10 and the front side surface of the rotor 16, is readily collected into the collector chamber CR by way of the central apertures 16*a*. In addition, the silicone oil, collected into the control chamber CR, is not supplied into the heat-generating chamber 10 by way of the second supply hole 19*b*, the first supply hole 3*d* and the supply groove 3*c*. When the silicone oil is collected into the control chamber CR, the inevitable air is pushed by the silicone oil to move from the upper side of the control chamber CR into the heat-generating chamber 10 by way of the gas groove 3*e* and the gas hole 3*f*. Thus, the bubbles exist in the space between the wall surface of the heat-generating chamber 10 and the outer surface of the rotor 16. All in all, the heat generation is decreased (i.e., the capacity reduction) in the space between the wall surface of the heat-generating chamber 10 and the outer surface of the rotor 16, thereby relieving the heating.

In accordance with the thus simplified arrangement, the viscous heater can reliably carry out the capacity reduction and the capacity enlargement by the variation of the physical properties in itself Therefore, the viscous heater does not necessarily require an electromagnetic clutch when the heating is needed or when the heating is not needed. In addition, the viscous heater does not need an external input for actuating the capacity variation. All in all, the viscous heater can realize the cost reduction and the weight reduction in heating apparatuses.

Further, in the viscous heater, the sum of the internal volumes of the enclosed heat-generating chamber 10, collector concavity 3*a*, etc., supply groove 3*c*, etc., and control chamber CR is little varied when the silicone oil is collected from the heat-generating chamber 10 into the control chamber CR, or when the silicone oil is supplied from the control chamber CR into the heat-generating chamber 10 reversibly. Accordingly, there hardly arises the negative pressure which results from the transfer of the silicone oil. As a result, the silicone oil is not brought into contact with newly introduced air, and is replenished with water, which is held in the air, at any time. Thus, the silicone oil is not deteriorated, and is not adversely affected by the air or water. Thus, in the viscous heater, the endurable heat generation can be inhibited from degrading even after a long period of service.

Furthermore, the viscous heater can produce such extra advantages that the number of component parts can be reduced, because the single independent rotary valve 19 is employed and controlled synchronously.

Moreover, the viscous heater is good in terms of boardability onto vehicles, or the like, because its axial length is reduced.

Second Preferred Embodiment

As illustrated in FIGS. 6 through 10, a second collector hole 19*c* of a rotary valve 19 is drilled through at a position which is disposed slightly on the right side in the rotary direction with respect to that of the First Preferred Embodiment in the drawing. Unless otherwise specified, the Second Preferred Embodiment has the same arrangements as those the First Preferred Embodiment. Accordingly, the same arrangements will be described with the same reference numerals.

Figure 7:
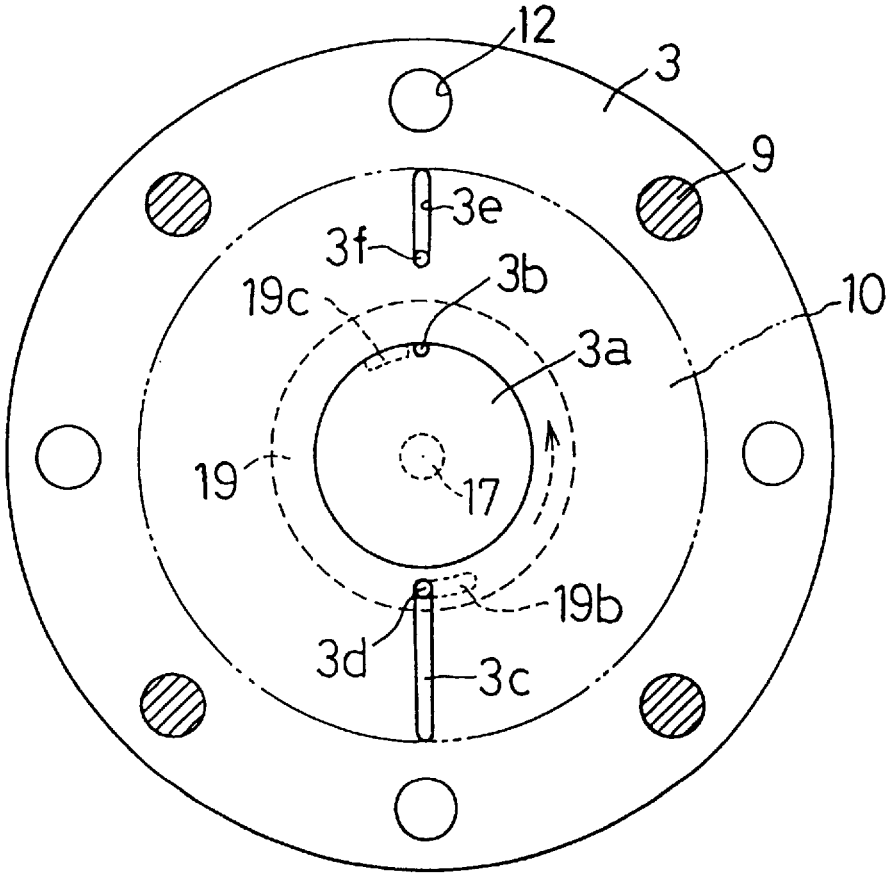
FIG. 7 is concerned with a rear plate, etc., of the variable capacity type viscous heater of the Second Preferred Embodiment, and is a plan view in the capacity enlargement, plan view which is viewed on a front side.

In the viscous heater, the heating is carried out too weakly when the temperature of the silicone oil, held in the control chamber CR, is low. Accordingly, as illustrated in FIG. 7, the rotary valve 19 is rotated counterclockwise in the drawing. In this instance, the first collector hole 3*b* and the second collector hole 19*c* are not communicated with each other, but the first supply hole 3*d* and the second supply hole 19*b* are communicated with each other. Hence, as designated at a rotary angle of −A° in FIG. 10, the collector concavity 3*a*, etc., are closed in the control chamber CR, and simultaneously the supply groove 3*c*, etc., are opened into the control chamber CR. As a result, the silicone oil, held in the heat-generating chamber 10, is not collected into the control chamber CR, but the silicone oil, held in the control chamber CR, is supplied into the heat-generating chamber 10. All in all, the heat generation is increased (i.e., the capacity enlargement) in the space between the wall surface of the heat-generating chamber 10 and the outer surface of the rotor 16, thereby intensifying the heating.

Figure 8:
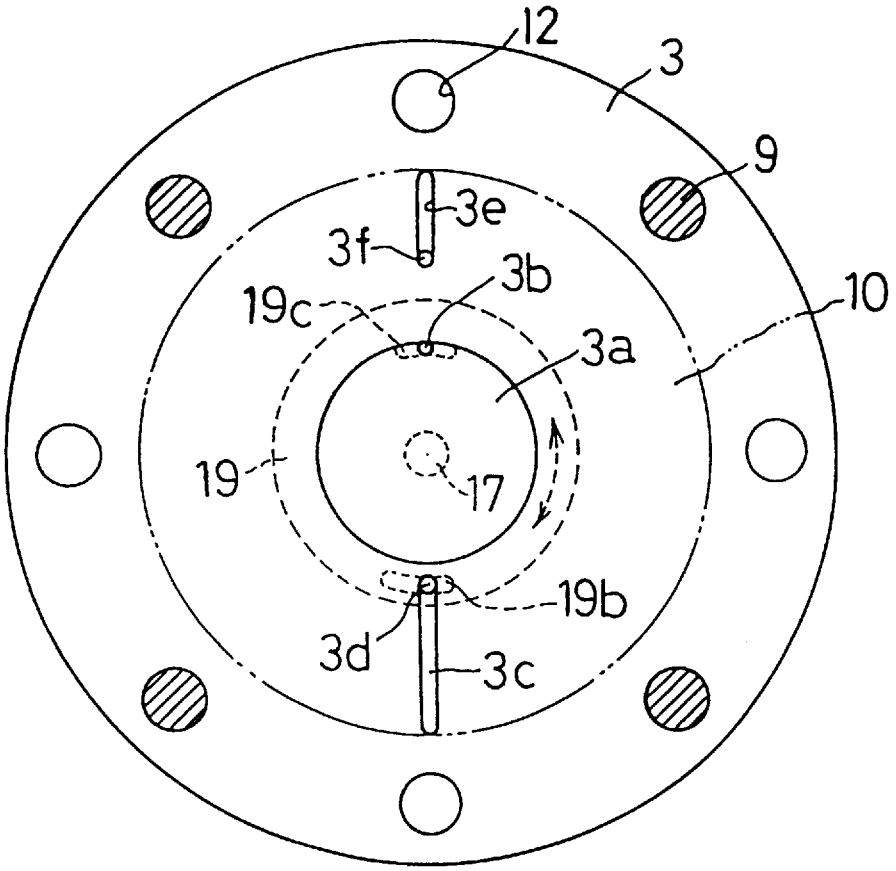
FIG. 8 is concerned with the rear plate, etc., of the variable capacity type viscous heater of the Second Preferred Embodiment, and is a plan view in the middle of the capacity enlargement, plan view which is viewed on a front side.

Then, as illustrated in FIG. 8, the rotary valve 19 is rotated slightly clockwise in the drawing when the temperature of the silicone oil, held in the control chamber CR, is increased slightly. In this instance, the first collector hole 3*b* and the second collector hole 19*a* are communicated with each other, and the first supply hole 3*d* and the second supply hole 19*b* are communicated with each other. Hence, as designated at a rotary angle between A° and B° in FIG. 10, the collector concavity 3*a*, etc., are opened in the control chamber CR, and simultaneously the supply groove 3*c*, etc., are opened into the control chamber CR. As a result, the silicone oil, held in the heat-generating chamber 10, is collected into the control chamber CR by way of the collector concavity 3*a*, etc., by the Weissenberg effect, and the silicone oil, held in the control chamber CR, is also supplied into the heat-generating chamber 10 by way of the supply groove 3*c*, etc. When the silicone oil is thus circulated, the heat generation is increased quickly in the space between the wall surface of the heat-generating chamber 10 and the outer surface of the rotor 16, because the angular momentum of the rotor 16 is increased. Note that the angular momentum is required to accelerate the low-speed silicone oil, which is supplied from the supply groove 3*c*, etc., into the heat-generating chamber 10. Therefore, the viscous heater can intensify the heating in a short period of time.

Figure 9:
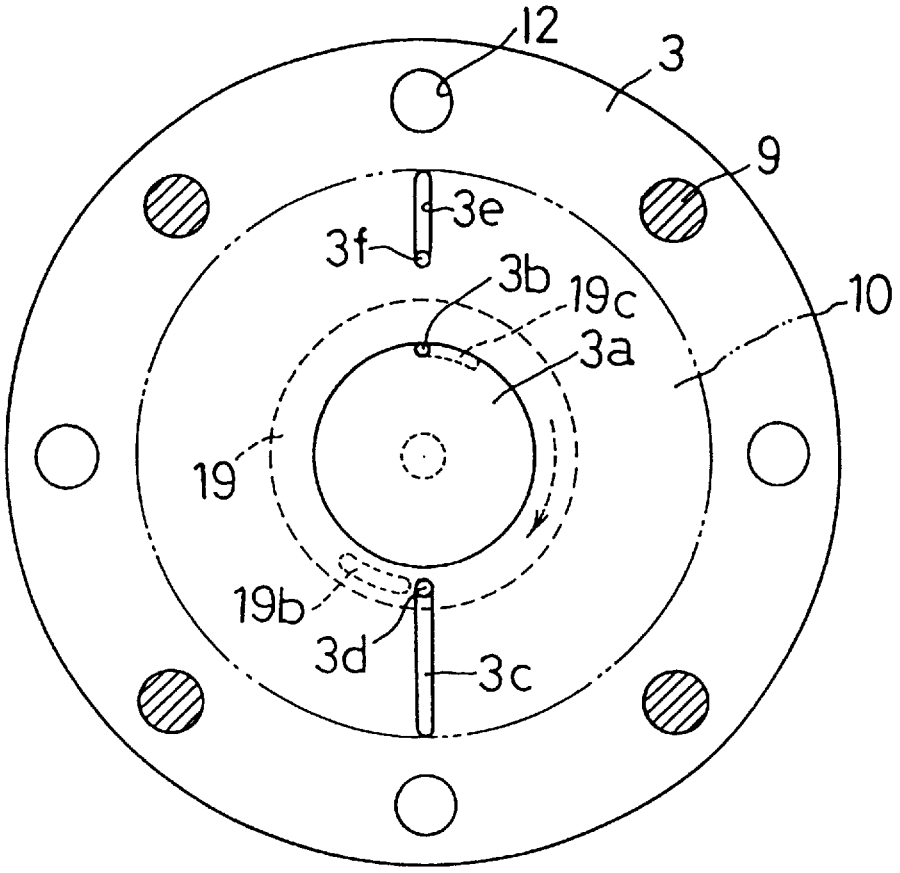
FIG. 9 is concerned with the rear plate, etc., of the variable capacity type viscous heater of the Second Preferred Embodiment, and is a plan view in the capacity reduction, plan view which is viewed on a front side.
Figure 10:
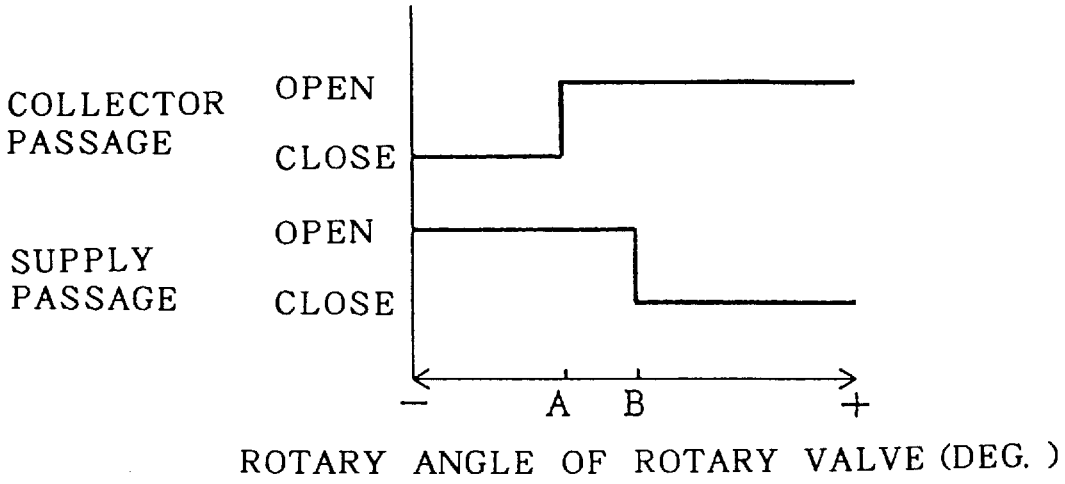
FIG. 10 is concerned with the variable capacity type viscous heater of the Second Preferred Embodiment, and is a timing chart which illustrates the relationship between the opening and closing of a collector passage and a supply passage and the rotary angle of the rotary valve.

On the other hand, the heating is carried out too strongly when the temperature of the silicone oil, held in the control chamber CR, is high. Accordingly, as illustrated in FIG. 9, the rotary valve 19 is rotated clockwise in the drawing. In this instance, the first collector hole 3*b* and the second collector hole 19*c* are communicated with each other, but the first supply hole 3*d* and the second supply hole 19*b* are not communicated with each other. Specifically, as designated at a rotary angle of +B° in FIG. 10, the collector concavity 3*a*, etc., are opened into the control chamber CR, and the supply groove 3*c*, etc., are closed in the control chamber CR. Consequently, in this instance, the silicone oil, held in the heat-generating chamber 10, is collected into the control chamber CR, but the silicone oil, collected in the control chamber 10, is not supplied into the heat-generating-chamber 10. As a result, the heat generation is decreased (i.e., the capacity reduction) in the space between the wall surface of the heat-generating chamber 10 and the outer surface of the rotor 16, thereby relieving the heating.

Unless otherwise specified, the viscous heater of the Second Preferred Embodiment can operate and produce advantages in the same manner as the First Preferred Embodiment.

Third Preferred Embodiment

Figure 11:
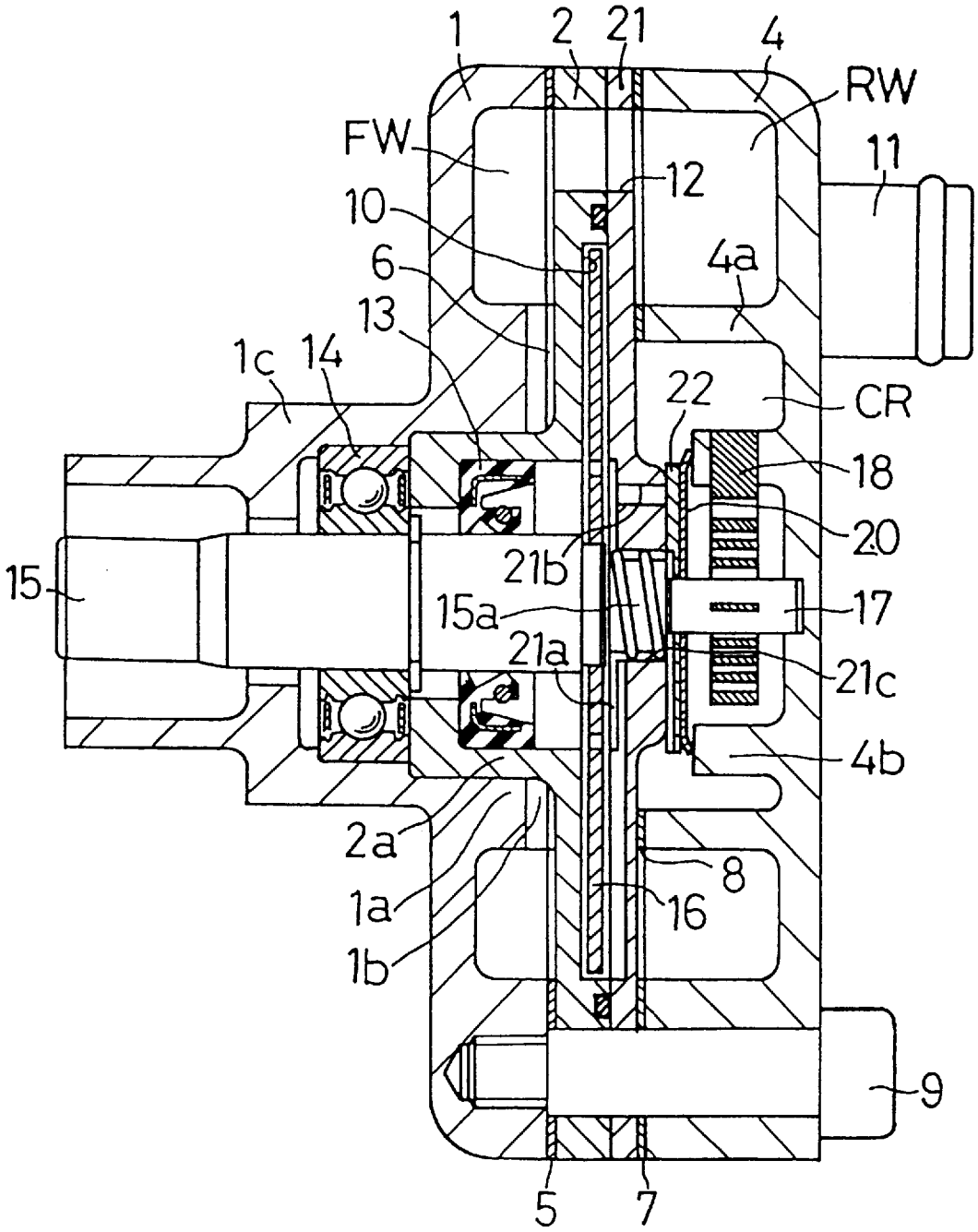
FIG. 11 is a vertical cross-sectional view of a variable capacity type viscous heater of a Third Preferred Embodiment.
Figure 13:
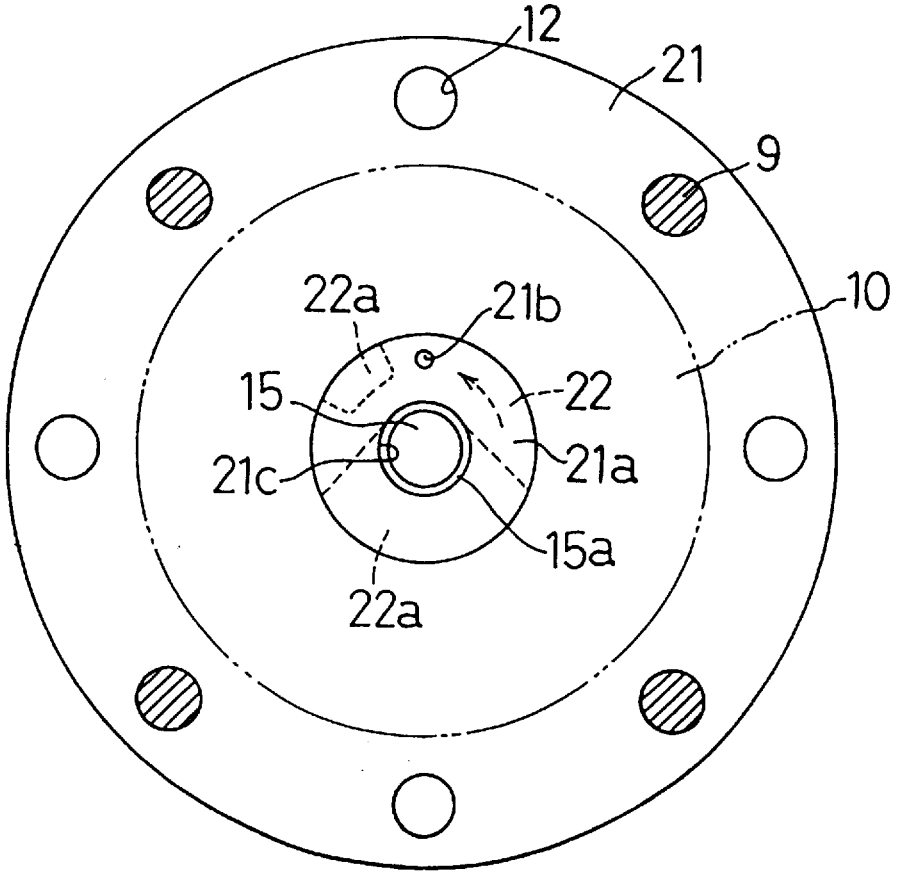
FIG. 13 is concerned with a rear plate, etc., of the variable capacity type viscous heater of the Third Preferred Embodiment, and is a plan view in the capacity enlargement, plan view which is viewed on a front side.
Figure 14:
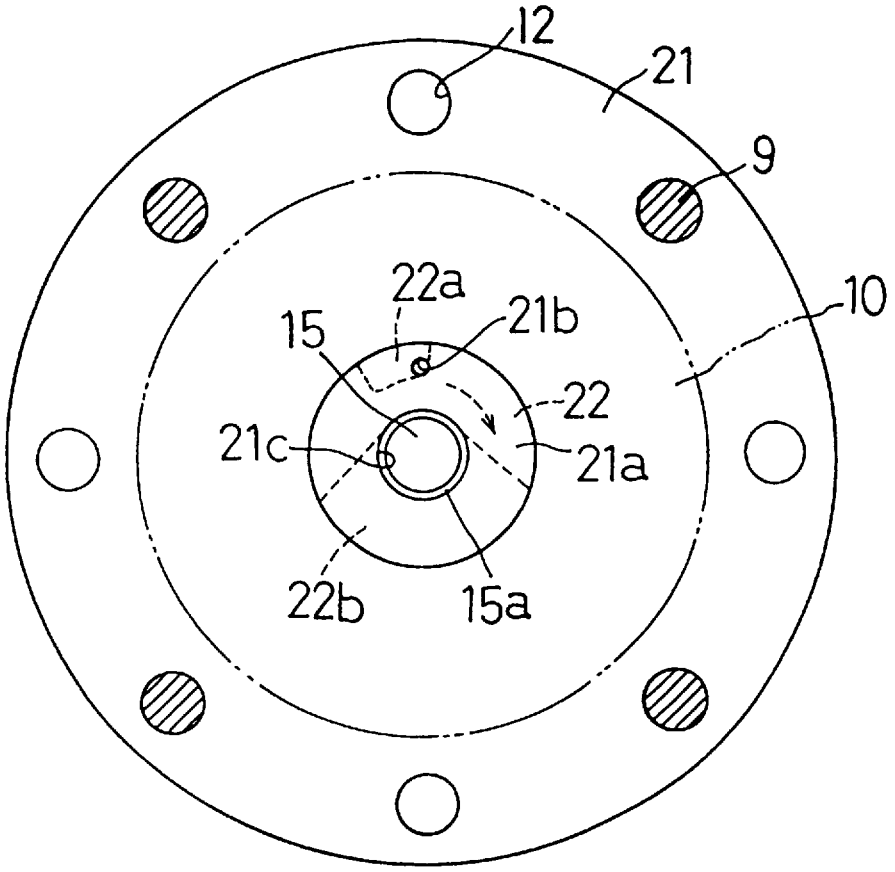
FIG. 14 is concerned with the rear plate, etc., of the variable capacity type viscous heater of the Third Preferred Embodiment, and is a plan view in the capacity reduction, plan view which is viewed on a front side.
Figure 15:
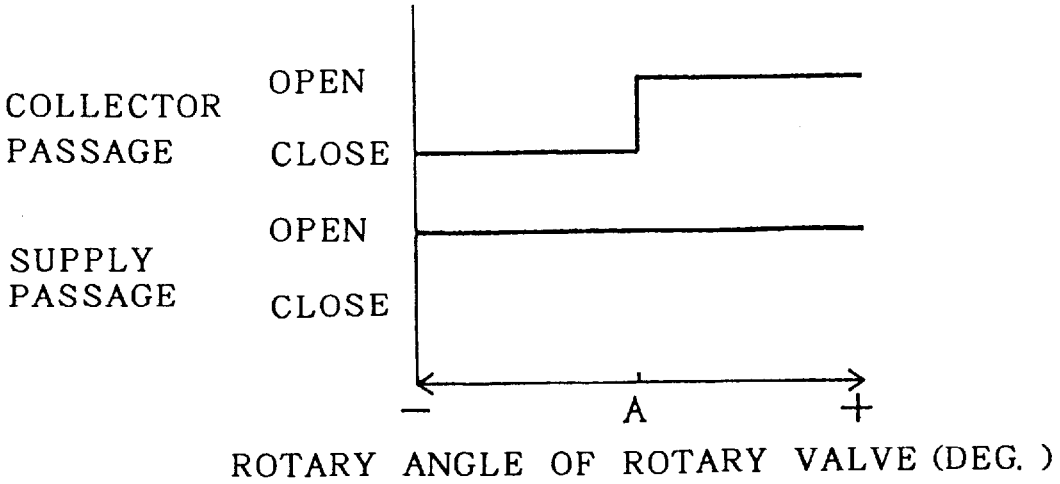
FIG. 15 is concerned with the variable capacity type viscous heater of the Third Preferred Embodiment, and is a timing chart which illustrates the relationship between the opening and closing of a collector passage and a supply passage and the rotary angle of the rotary valve.

As illustrated in FIG. 11, the viscous heater employs a rear plate 21 which is protruded rearwardly in a central region. As illustrated in FIGS. 13 and 14, on a front-end surface of the rear plate 21, a collector concavity 21*a* is dented so that it faces a central region of a heat-generating chamber 10. Further, in the rear plate 21, a first collector hole 21*b* is drilled through at a position on an outer side of the collector concavity 21*a* so that it extends to a rear-end surface of the rear plate 21. Furthermore, at the center of the front-end surface of the rear plate 21, a first supply hole 21*c* is drilled through so that it also extends to a rear-end surface of the rear plate 21. Moreover, as illustrated in FIG. 11, on an elongated rear-end peripheral surface of a driving shaft 15, a spiral groove 15*a* is formed. Note that the spiral groove 15*a* works as the compulsory supply means, and that the portion around the spiral groove 15*a* of the driving shaft 15 is accommodated in the first supply hole 21*c* so as to constitute a simple screw-type pump.

Figure 12:
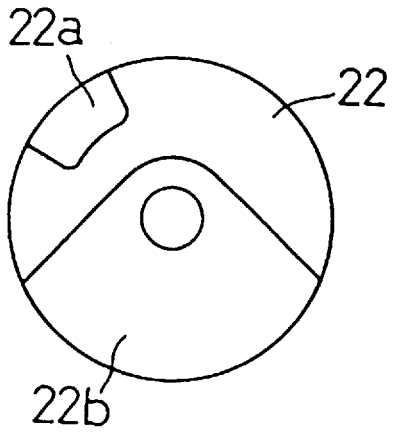
FIG. 12 is concerned with a rotary valve of the variable capacity type viscous heater of the Third Preferred Embodiment, and is a plan view which is viewed on a front side.

Moreover, the viscous heater employs a rotary valve 22 as illustrated in FIG. 12. In a front-end surface of the rotary valve 22, a sector-shaped collector groove 22*a* is dented so that it can communicate with the first collector 21*b* according to a rotary angle of the rotary valve 22, and a sector-shaped second supply groove 22*b* is dented so that it can communicate with the first supply hole 21*c* regardless of a rotary angle of the rotary valve 22. Thus, the collector concavity 21*a*, the first collector hole 21*b* and the second collector groove 22*a* constitute the collector passage. Whilst, the first supply hole 21*c* and the second supply groove 22*b* constitute the supply passage. In the arrangement, note that it is unnecessary to always communicate the control chamber CR with the heat-generating chamber 10 by way of the supply passage (e.g., the first supply hole 21*c* and the second supply groove 22*b*). Unless otherwise specified, the Third Preferred Embodiment has the same arrangements as of the First Preferred Embodiment. Accordingly, the same arrangements will be described with the same reference numerals.

In the thus constructed viscous heater, the heating is carried out too weakly when the temperature of the silicone oil, held in the control chamber CR, is low. Accordingly, as illustrated in FIG. 13, the rotary valve 22 is rotated counterclockwise in the drawing. In this instance, the first collector hole 21*b* and the second collector groove 22*a* are not communicated with each other. Hence, as designated at a rotary angle of −A° in FIG. 15, the collector concavity 21*a*, etc., are closed in the control chamber CR, and the first supply hole 21*c*, etc., are opened into the control chamber CR. As a result, the silicone oil, held in the heat-generating chamber 10, is not supplied into the control chamber CR by way of the collector concavity 21*a*, the first collector hole 21*b* and the second collector hole 22*a*. Whilst, the spiral groove 15*a* forcibly supplies the silicone oil, collected in the control chamber CR, into the heat-generating chamber 10 by way of the first supply hole 21*c* when the driving shaft 15 is rotated. All in all, the heat generation is increased (i.e., the capacity enlargement) in the space between the wall surface of the heat-generating chamber 10 and the outer surface of the rotor 16, thereby intensifying the heating in a short period of time.

On the other hand, the heating is about to be carried out too strongly when the temperature of the silicone oil, held in the control chamber CR, is increased. Accordingly, as illustrated in FIG. 14, the rotary valve 22 is rotated clockwise in the drawing. Thus, the first collector hole 21*b* and the second collector groove 22*a* are communicated with each other. Specifically, as designated at a rotary angle of +A° in FIG. 15, the collector concavity 21*a*, etc., are opened into the control chamber CR. As a result, even when the spiral groove 15*a* forcibly supplies the silicone oil, collected in the control chamber CR, into the heat-generating chamber 10, the silicone oil, held in the heat-generating chamber 10, is collected into the control chamber CR by way of the collector concavity 21*a*, the first collector hole 21*b* and the second collector groove 22*a*. As a result, the heat generation is decreased (i.e., the capacity reduction) in the space between the wall surface of the heat-generating chamber 10 and the outer surface of the rotor 16, thereby relieving the heating.

Unless otherwise specified, the viscous heater of the Third Preferred Embodiment can operate and produce advantages in the same manner as the First Preferred Embodiment.

Fourth Preferred Embodiment

Figure 16:
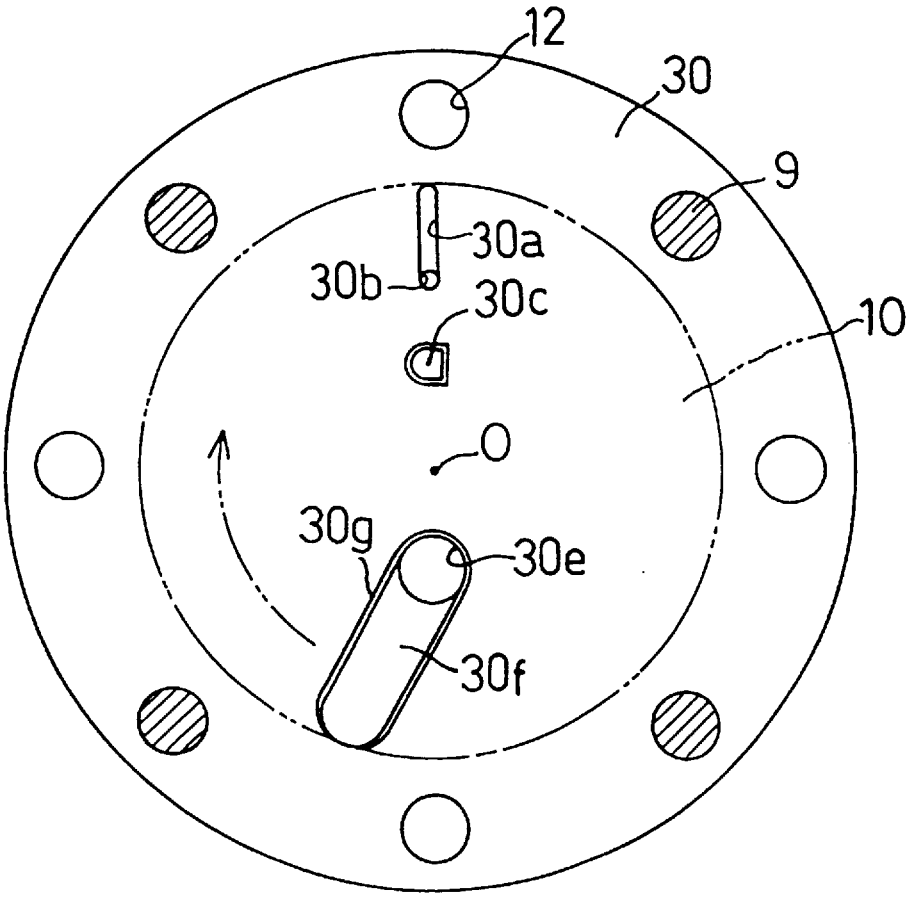
FIG. 16 is concerned with a rear plate, etc., of a variable capacity type viscous heater of a Fourth Preferred Embodiment, and is a plan view which is viewed on a front side.
Figure 17:
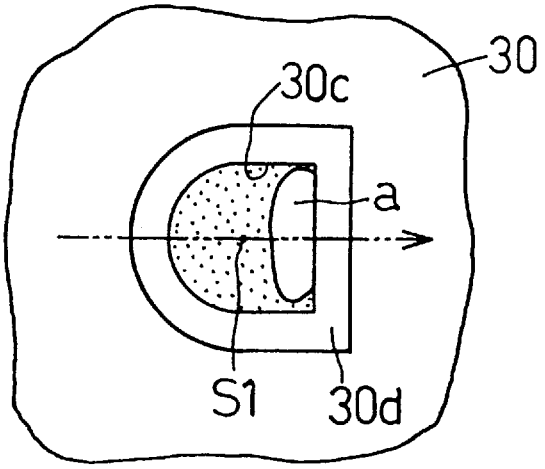
Figure 17:
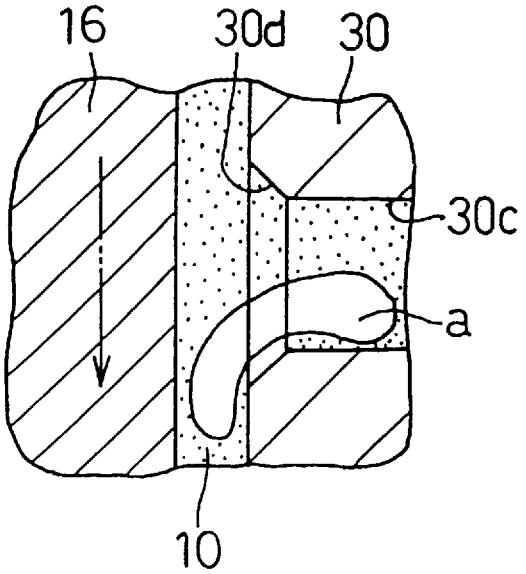

The viscous beater employs a rear plate 30 as illustrated in FIG. 16. In the rear plate 30, a gas passage is formed. For example, the gas passage includes a gas groove 30*a*, and a gas hole 30*b*. The gas groove 30*a* is dented in the rear plate 30, and is extended from a top end of a heat-generating chamber 10 to an inner side. The gas hole 30*b* is communicated with an inner end of the gas groove 30*a*, and is drilled through up to an upper end of a control chamber CR. Note that the gas groove 30*a* is chamfered around the opening thereof on the side of the heat-generating chamber 10 (not shown in the drawing). Further, in the rear plate 30, a first collector hole 30*c* is drilled through at an upper position in a central region of the rear plate 30. Note that the first collector hole 30*c* works as the collector passage. As illustrated in FIGS. 17(A) and (B), the opening of the first collector hole 30*c* is formed like an arc on the side of the heat-generating chamber 10. The opening of the first collector hole 30*c* includes an arc-shaped portion which is formed about the center S1 on an opposite rim on a rear side with respect to a rotary direction of a rotor 16 shown by an alternate-long-and-two-dash line of FIG. 17(A), and a linear portion which is on another opposite rim on a front side with respect to the rotary direction of the rotor 16. Furthermore, the first collector hole 30*c* is subjected to chamfering 30d around the opening on a side of the heat-generating chamber 10.

Figure 18:
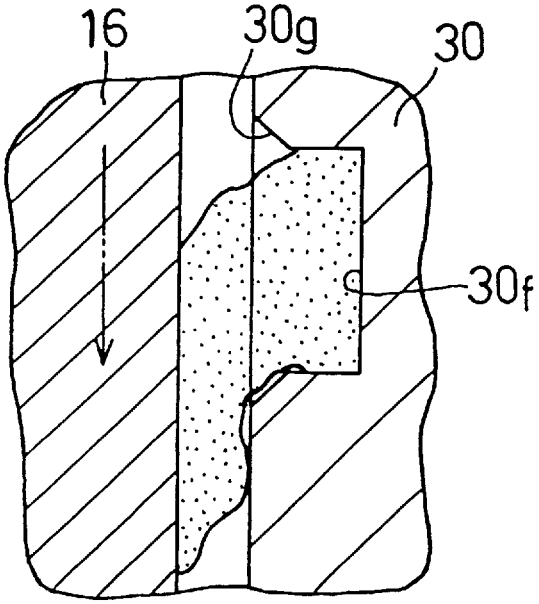
FIG. 18 is concerned with the variable capacity type viscous heater of the Fourth Preferred Embodiment, and is an enlarged cross-sectional view around a supply groove, etc.

Moreover, as illustrated in FIG. 16, at a lower position in a central region of the rear plate 30, a first supply hole 30*e* is also drilled through up to a rear end surface of the rear plate 30. The first supply hole 30*e* has a larger communicating area than that of the first supply hole 30*c*, and works as part of the supply passage. In addition, as illustrated in FIG. 18, a supply groove 30*f* is dented in the rear plate 30. The supply groove 30*f* is opened on a side of the heat-generating chamber 10, and is communicated with the first supply hole 30*e* at an inner end. Thus, the supply groove 30*f* constitutes the rest of the supply passage. Note that the supply groove 30*f* works as the distributor passage. As illustrated in FIG. 16, the supply groove 30*f* is extended to an outer periphery of the rotor 16, and is inclined with respect to a diametric direction of the rotor 16 on a forward side with respect to the rotary direction of the rotor 16 shown by an alternate-long-and-two-dash line of FIG. 16. As illustrated in FIG. 18, the supply groove 30*f* is subjected to chamfering 30*g* around the opening on a side of the heat-generating chamber 10. Unless otherwise specified, the Fourth Preferred Embodiment has the same arrangements as those the First Preferred Embodiment. Accordingly, the same arrangements will be described with the same reference numerals.

In the thus constructed viscous heater, the rotor 16 rotates in the heat-generating chamber 10, thereby supplying the silicone oil, held in the control chamber CR, into the heat-generating chamber 10 by way of the supply groove 30*f* and the first supply hole 30*e* by the own weight of the silicone oil and the extendible viscosity thereof. In this instance, the silicone oil, collected in the control chamber CR, is supplied to an outer peripheral region of the heat-generating chamber 10 by way of the supply groove 30*f* smoothly and quickly. Then, the silicone oil, supplied to the outer peripheral region of the heat-generating chamber 10, is developed by the Weissenberg effect up to the central region of the heat-generating chamber 10 over the entire region quickly.

Evaluation

Figure 19:
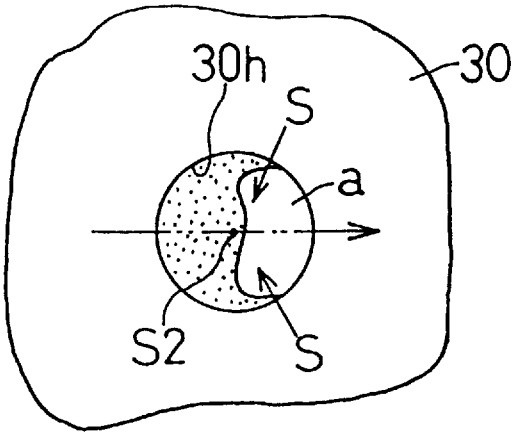
Figure 19:
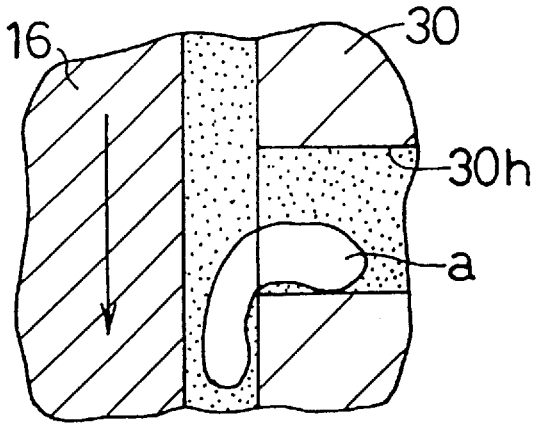
Figure 20:
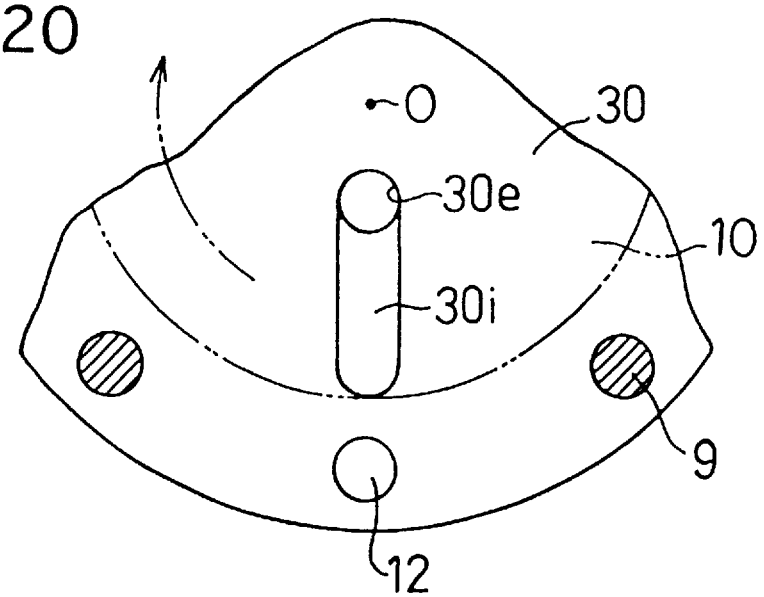
FIG. 20 is concerned with a variable capacity type viscous heater of a comparative example, and is a partly cross-sectional view which is viewed similarly to FIG. 16.

As a comparative example, a viscous heater is prepared as illustrated in FIGS. 19 and 20.

For instance, as illustrated in FIGS. 19(A) and (B), in the comparative viscous heater, a first collector hole 30*h* is drilled through in a rear plate 30. The first collector hole 30*h* is formed as a circular configuration, which has the center at S2, in cross-section. Note that the first collector hole 30*h* is not chamfered around the opening on a side of a heat-generating chamber 10. Further, as illustrated in FIG. 20, a supply groove 30*i* is dented in the rear plate 30. The supply groove 30*i* is extended to an outer periphery of a rotor 16, but is not inclined with respect to a diametric direction of the rotor 16 on a forward side with respect to the rotary direction of the rotor 16 shown by an alternate-long-and-two-dash line of FIG. 20. Note that the supply groove 30*i* is not chamfered around the opening on a side of the heat-generating chamber 10. Unless otherwise specified, the comparative viscous heater has the same arrangements as those the Fourth Preferred Embodiment.

In the thus constructed comparative viscous heater, bubbles "a", which are mingled in the silicone oil, are less likely to move to the control chamber CR smoothly and quickly. The disadvantage is believed to be caused by the fact that the bubbles "a" receive a relatively large contraction force "s" in the first collector hole 30*h*. Unless otherwise specified, the contraction force "s" is hereinafter shown by a vector in the drawing. The relatively large contraction force "s" is exerted to the bubbles "a" from the forward-side rim of the rotor 16 with respect to the rotary direction of the rotor 16, because the first collector hole 30*h* is formed as a general circular configuration in cross-section as illustrated in FIGS. 19 (A) and (B). Additionally, it is believed that the bubbles "a" are less likely to move into the first collector hole 30h, because the opening of the first collector hole 30*h* is formed substantially perpendicularly on the side of the heat-generating chamber 10.

Moreover, in the thus constructed comparative viscous heater, the silicone oil, collected in the control chamber CR, is extremely less likely to be supplied to an outer peripheral region of the heat-generating chamber 10. The disadvantage is believed to be caused by the following arrangement: the supply groove 30*i* is extended to an outer periphery of the rotor 16 without inclination as illustrated in FIG. 20. As a result, the silicone oil, held in the supply groove 30*i*, is pressed onto a lateral-wall side of the supply groove 30*i* by the rotation of the rotor 16. Thus, the silicone oil is believed to be less likely to move to an outer peripheral side of the rotor 16. Additionally, it is believed that the silicone oil is less likely to move into the heat-generating chamber 10, because the opening of the supply groove 30*i* is formed substantially perpendicularly on the side of the heat-generating chamber 10.

On the other hand, in the viscous heater of the Fourth Preferred Embodiment, the first collector hole 30*c* is formed as a configuration which is less likely to exert the large contraction force "s" to the bubbles "a". In addition, the bubbles "a" are likely to move into the control chamber CR smoothly and quickly, because the opening of the first collector hole 30*c* is subjected to the chamfering 30*e* on the side of the heat-generating chamber 10.

Moreover, as illustrated in FIGS. 16 and 18, in the viscous heater of the Fourth Preferred Embodiment, the supply groove 30*f* is extended to an outer periphery of the rotor 16 while it is inclined with respect to a diametric direction of the rotor 16 on a forward side with respect to the rotary direction of the rotor 16. In addition, the supply groove 30*f* is provided with the chamfering 30*g*. As a result, the silicone oil, held in the control chamber CR, is supplied to the outer peripheral region of the heat-generating chamber 10 smoothly and quickly.

All in all, in the viscous heater of the Fourth Preferred Embodiment, it is understood that the heat generation is increased quickly in the space between the wall surface of the heat-generating chamber 10 and the outer surface of the rotor 16 right after starting the viscous heater, and in the capacity enlargement thereof.

Fifth Preferred Embodiment

Figure 21:
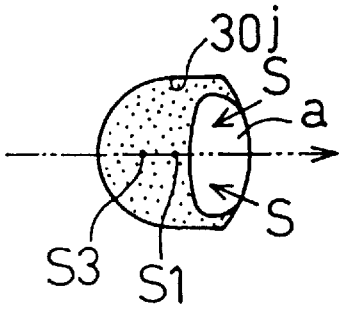
FIG. 21 is concerned with a variable capacity type viscous heater of a Fifth Preferred Embodiment, and is an enlarged plan view which is viewed on a heat-generating chamber side of a first collector hole.

As illustrated in FIG. 21, in the viscous heater of the Fifth Preferred Embodiment, a first collector hole 30*j* is drilled through in a rear plate 30. On an opposite rim on a rear side with respect to a rotary direction of a rotor 16 shown by an alternate-long-and-two-dash line of the drawing, the first collector hole 30*j* is formed as an arc which is formed about the center S1. Likewise, on another opposite rim on a front side with respect to the rotary direction of the rotor 16, the first collector hole 30*j* is formed as an arc which is formed about the center S3. Note that the center S3 is disposed on a rear side with respect to the center S1 in the rotary direction of the rotor 16, and that the radius of the arc, which is disposed on an opposite rim and formed about the center S3, is larger than that of the arc, which is disposed on an opposite rim and formed about the center S1. Unless otherwise specified, the viscous heater of the Fifth Preferred Embodiment has the same arrangements as those the Fourth Preferred Embodiment.

In the thus constructed viscous heater, the first collector hole 30*j* has a configuration which little exerts a large contraction force "s" to bubbles "a". Hence, the viscous heater can operate and produce advantages in the same manner as the Fourth Preferred Embodiment.

Sixth Preferred Embodiment

Figure 22:
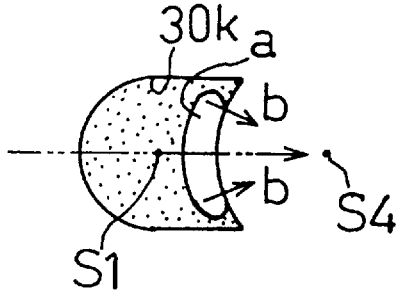
FIG. 22 is concerned with a variable capacity type viscous heater of a Sixth Preferred Embodiment, and is an enlarged plan view which is viewed on a heat-generating chamber side of a first collector hole.

As illustrated in FIG. 22, in the viscous heater of the Sixth Preferred Embodiment, a first collector hole 30*k* is drilled through in a rear plate 30. On an opposite rim on a rear side with respect to a rotary direction of a rotor 16 shown by an alternate-long-and-two-dash line of the drawing, the first collector hole 30*k* is formed as an arc which is formed about the center S1. Likewise, on another opposite rim on a front side with respect to the rotary direction of the rotor 16, the first collector hole 30*k* is formed as an arc which is formed about the center S4. Note that the center S4 is disposed on a front side with respect to the center S1 in the rotary direction of the rotor 16, and that the radius of the arc, which is disposed on another opposite rim and formed about the center S4, is larger than that of the arc, which is disposed on an opposite rim and formed about the center S1. Unless otherwise specified, the viscous heater of the Sixth Preferred Embodiment has the same arrangements as those the Fourth Preferred Embodiment.

In the thus constructed viscous heater, the first collector hole 30*k* has a configuration which can exert an expansion force "b" to bubbles "a". Hence, the viscous heater can operate and produce advantages in the same manner as the Fourth Preferred Embodiment.

Seventh Preferred Embodiment

Figure 23:
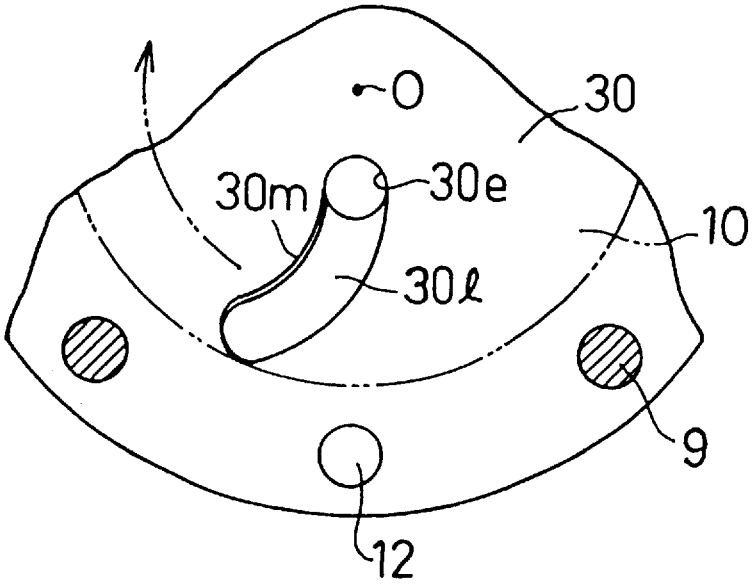
FIG. 23 is concerned with a variable capacity type viscous heater of a Seventh Preferred Embodiment, and is a partly cross-sectional view which is viewed similarly to FIG. 16.

As illustrated in FIG. 23, a supply groove 30*c* is dented in a rear plate 30. The supply groove 30*c* is extended to an outer periphery of a rotor 16, and is curved with respect to a diametric direction of the rotor 16 on a forward side with respect to a rotary direction of the rotor 16 shown by an alternate-long-and-two-dash line of the drawing. Moreover, the supply groove 30*c* is subjected to chamfering 30m around the opening on a side of a heat-generating chamber 10, but only on a front-side opposite rim with respect to the rotary direction of the rotor 16. Unless otherwise specified, the viscous heater of the Seventh Preferred Embodiment has the same arrangements as those the Fourth Preferred Embodiment.

In the thus constructed viscous heater, the silicone oil, held in the supply groove 30*c*, is likely to be moved by the rotation of the rotor 16 to an outer peripheral side of the rotor 16. Hence, the viscous heater can operate and produce advantages in the same manner as the Fourth Preferred Embodiment.

Eighth Preferred Embodiment

Figure 24:
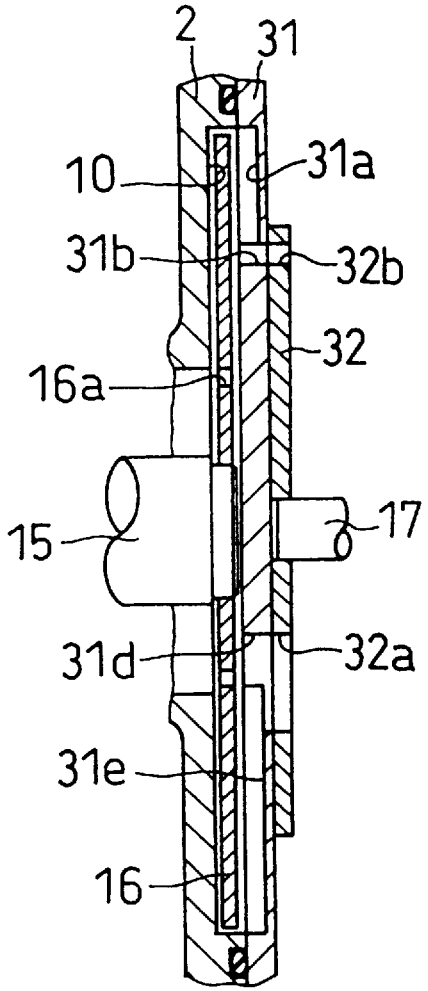
FIG. 24 is a cross-sectional view of major portions of a variable capacity type viscous heater of an Eighth Preferred Embodiment.
Figure 26:
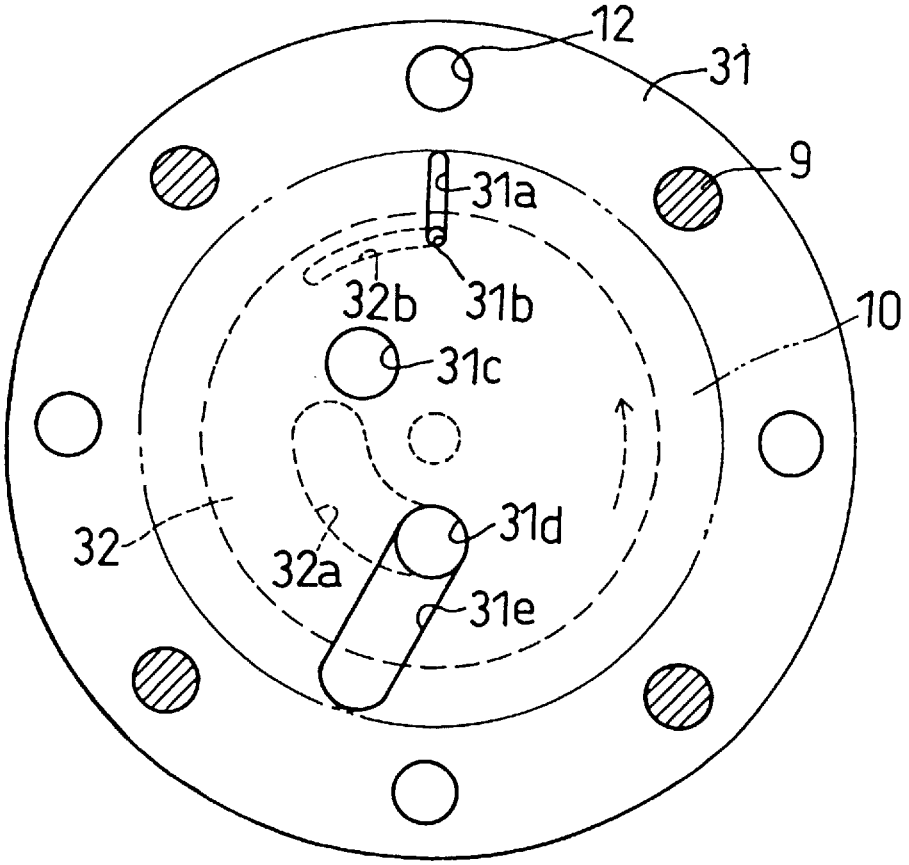
FIG. 26 is concerned with a rear plate, etc., of the variable capacity type viscous heater of the Eighth Preferred Embodiment, and is a plan view in the capacity enlargement, plan view which is viewed on a front side.
Figure 27:
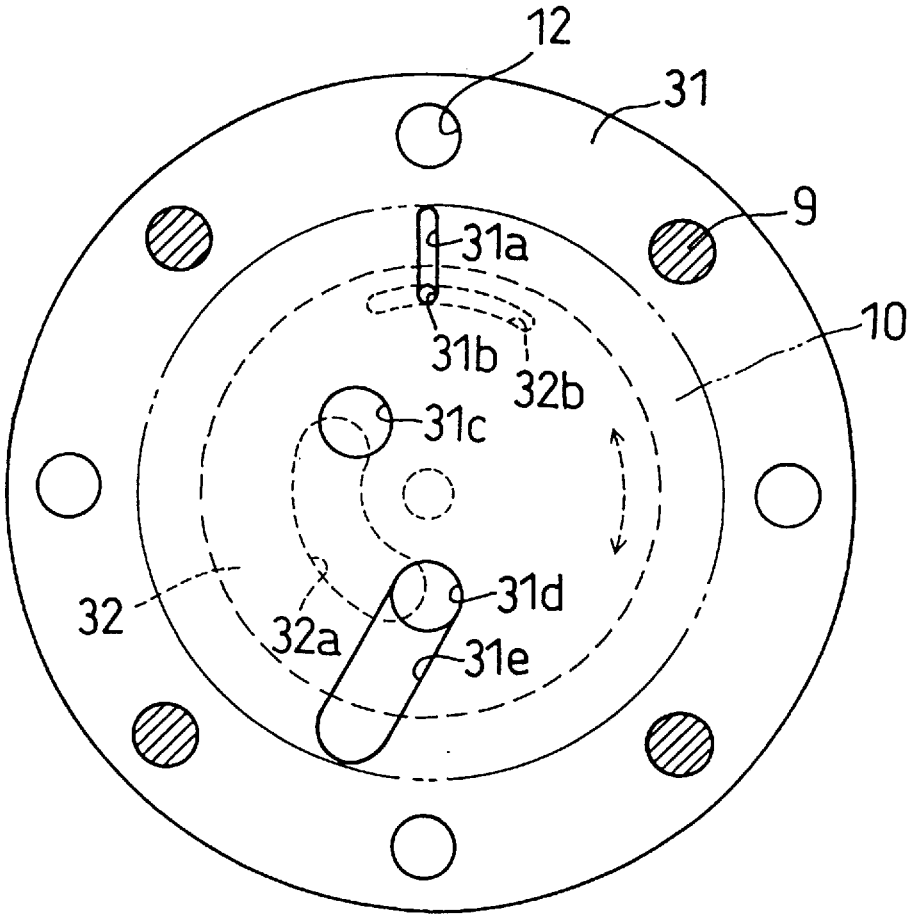
FIG. 27 is concerned with the rear plate, etc., of the variable capacity type viscous heater of the Eighth Preferred Embodiment, and is a plan view in the middle of the capacity enlargement, plan view which is viewed on a front side.
Figure 28:
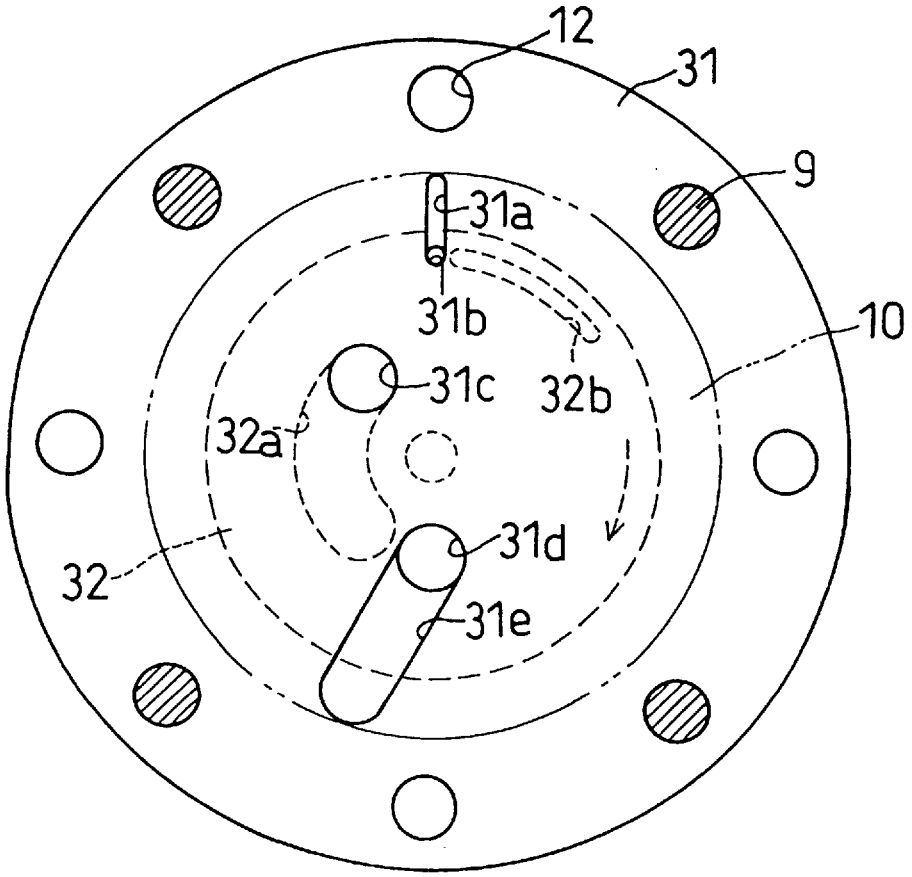
FIG. 28 is concerned with the rear plate, etc., of the variable capacity type viscous heater of the Eighth Preferred Embodiment, and is a plan view in the capacity reduction, plan view which is viewed on a front side.
Figure 29:
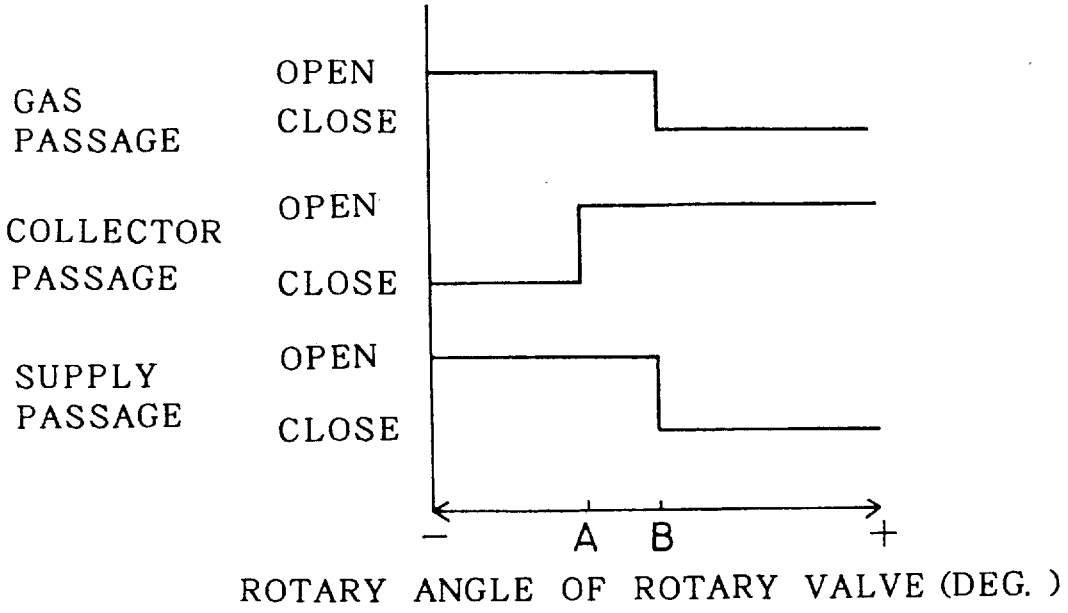
FIG. 29 is concerned with the variable capacity type viscous heater of the Eighth Preferred Embodiment, and is a timing chart which illustrates the relationship between the opening and closing of a collector passage, a supply passage and a gas passage and the rotary angle of the rotary valve.

The viscous heater employs a rear plate 31 and a rotary valve 32 as illustrated in FIG. 24. As illustrated in FIGS. 26 through 28, in the rear plate 31, a gas passage is formed. The gas passage includes a gas groove 31*a*, and a first gas hole 31*b*. The gas groove 31*a* is dented in the rear plate 30, and is extended from a top end of a heat-generating chamber 10 to an inner side. The gas hole 31*b* is communicated with an inner end of the gas groove 31*a*, and is drilled through up to an upper end of a control chamber CR. Further, in the rear plate 31, a first collector hole 31*c* is drilled through up to a rear-end surface of the rear plate 31. The first collector hole 31*c* is disposed at an upper position obliquely with respect to a central region of the rear plate 31, and is formed as a circular shape in cross-section. Note that the first collector hole 31*c* works as the collector passage. Furthermore, in the rear plate 31, a first supply hole 31*d* is also drilled through up to a rear-end surface of the rear plate 30 at a lower position in a central region of the rear plate 30. The first supply hole 31*d* has an identical diameter with that of the first collector hole 31*c*. Note that the first supply hole 31*d* works as part of the supply passage. Moreover, a supply groove 31*e* is dented in the rear plate 31. The supply groove 31*e* is opened on a side of the heat-generating chamber 10, and is communicated with the first supply hole 31*d* at an inner end, thereby constituting the rest of the supply passage. Note that the supply groove 31*e* works as the distributor passage. As illustrated in FIGS. 26 through 28, the supply groove 31*e* is extended to an outer periphery of the rotor 16, and is inclined with respect to a diametric direction of the rotor 16 on a forward side with respect to the rotary direction of the rotor 16.

Figure 25:
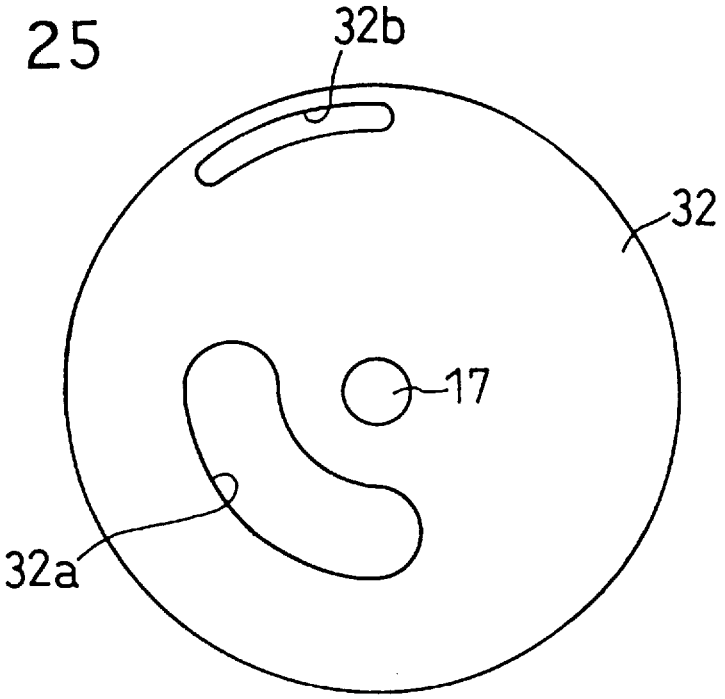
FIG. 25 is concerned with a rotary valve of the variable capacity type viscous heater of the Eighth Preferred Embodiment, and is a plan view which is viewed on a front side.

Whilst, the rotary valve 32 has a larger diameter than that of the First through Seventh Preferred Embodiments. As illustrated in FIG. 25, in the rotary valve 32, a single arc-shaped collector-and-supply slot 32*a* is drilled through. Depending on a rotary angle of the rotary valve 32, the collector-and-supply slot 32*a* can be communicated with the first collector hole 31*c* and the first supply hole 31*d*. Moreover, in the rotary valve 32, an arc-shaped second gas slot 32*b* is drilled through. Depending on a rotary angle of the rotary valve 32, the second gas slot 32*b* can be communicated with the first gas hole 31*b*. Unless otherwise specified, the Eighth Preferred Embodiment has the same arrangements as those the First Preferred Embodiment. Accordingly, the same arrangements will be described with the same reference numerals.

In the viscous heater, the heating is carried out too weakly when the temperature of the silicone oil, held in the control chamber CR, is low. Accordingly, as illustrated in FIG. 26, the rotary valve 32 is rotated counterclockwise in the drawing. In this instance, the first collector hole 31*c* and the collector-and-supply slot 32*a* are not communicated with each other, but the first supply hole 31*d* and the collector-and-supply slot 32*a* are communicated with each other. Hence, as designated at a rotary angle of −A° in FIG. 29, the first collector hole 31*c*, etc., are closed in the control chamber CR, the first supply hole 31*d*, etc., are opened into the control chamber CR, and the gas groove 31*a*, etc., are further opened into the control chamber CR. At this moment, the gas groove 31*a*, etc., are opened by the rotary valve 32 so that the gas, held in the heat-generating chamber 10, is moved into the control chamber CR by way of the gas groove 31*a*, etc., in the capacity enlargement. As a result, the silicone oil, held in the heat-generating chamber 10, is likely to be supplied into the heat-generating chamber 10. All in all, the heating can be securely intensified.

Then, as illustrated in FIG. 27, the rotary valve 32 is rotated slightly clockwise in the drawing when the temperature of the silicone oil, held in the control chamber CR, is increased slightly. In this instance, the first collector hole 31*c* and the first supply hole 31*d* are communicated with the collector-and-supply slot 32*a*, and simultaneously the first gas hole 31*b* and the second gas hole 32*b* are communicated with each other. Hence, as designated at a rotary angle between A° and B° in FIG. 29, the collector hole 31*c*, etc., are opened in the control chamber CR, the first supply hole 31*d*, etc., are opened into the control chamber CR, and the gas groove 31*a*, etc., are opened into the control chamber CR. Also in this phase, the rotary valve 32 opens the gas groove 31*a*, etc., so that the flow of the silicone oil can be facilitated.

On the other hand, when the temperature of the silicone oil, held in the control chamber CR, is increased, the rotary valve 32 is rotated further clockwise in the drawing as illustrated in FIG. 28. Thus, the first collector hole 31*c* and the collector-and-supply slot 32*a* are communicated with each other, but the first supply hole 31*d* and the collector-and-supply slot 32*a* are not communicated with each other. Simultaneously therewith, the first gas hole 31*b* and the second gas hole 32*b* are not communicated with each other. Specifically, as designated at a rotary angle of +B° in FIG. 29, the collector hole 31*c*, etc., are opened into the control chamber CR. At the same time, the first supply hole 31*d*, etc., are closed in the control chamber CR, and the gas groove 31*a*, etc., are closed in the control chamber CR. In this instance, the rotary valve 32 closes the gas passage 31*a*, etc., so that the gas can be inhibited from moving into the control chamber CR in the capacity reduction. As a result, the silicone oil can be collected facilitatively as the pressure increases in the heat-generating chamber 10. All in all, the heating can be securely relieved. Moreover, in the Eighth Preferred Embodiment, the rotary valve 32 can be simplified, because the collector hole 31*c* and the first supply hole 31d are opened and closed by the single collector-and-supply slot 32*a* which is drilled through in the rotary valve 32. Hence, the arrangement is advantageous in terms of costs.

Unless otherwise specified, the viscous heater of the Eighth Preferred Embodiment can operate and produce advantages in the same manner as the First Preferred Embodiment.

Ninth Preferred Embodiment

Figure 30:
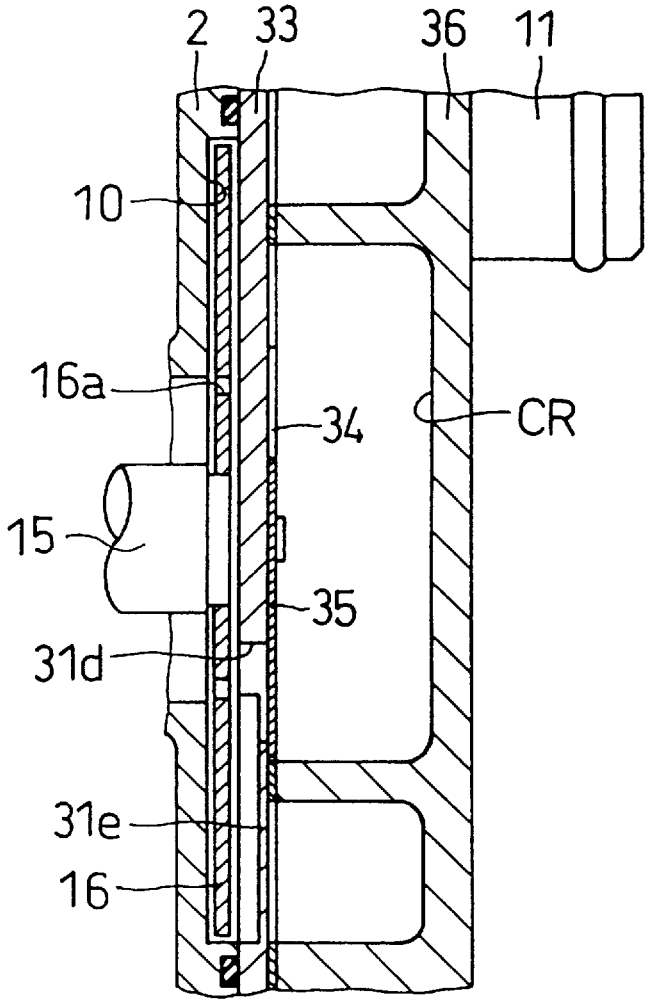
FIG. 30 is a cross-sectional view of major portions of a variable capacity type viscous heater of a Ninth Preferred Embodiment.
Figure 31:
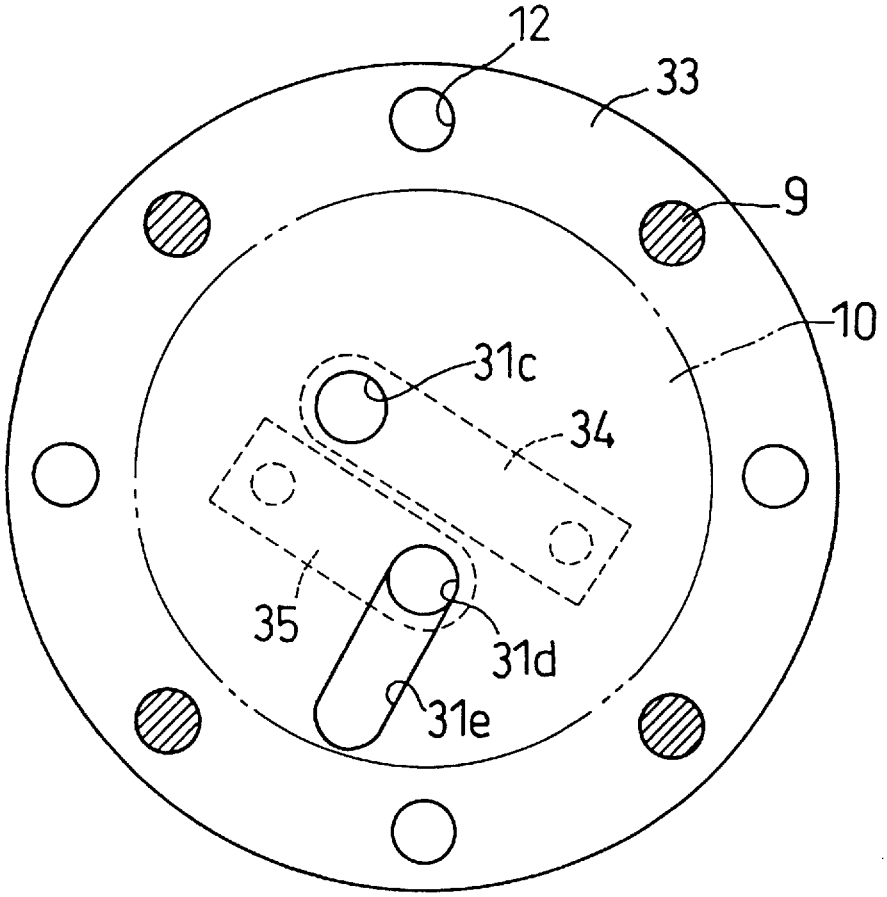
FIG. 31 is a plan view of a rear plate, etc., of the variable capacity type viscous heater of the Ninth Preferred Embodiment.

As illustrated in FIGS. 30 and 31, the viscous heater employs a rear plate 33, a reed type flap valve 34, and a bimetal type flap valve 35. In the rear plate 33, a first collector hole 31*c*, etc., are used both as the collector passage and the gas passage. The reed type flap valve 34 closes the first collector hole 31*c* on a side of a control chamber CR. The bimetal type flap valve 35 closes a first supply hole 31*d* on a side of the control chamber CR. In addition, the viscous heater employs a rear housing body 36 which is free from the second rib protruding into the control chamber CR. Unless otherwise specified, the Ninth Preferred Embodiment has the same arrangements as those of the First and Eighth Preferred Embodiments. Accordingly, the same arrangements will be described with the same reference numerals.

In the thus constructed viscous heater, the reed type flap valve 34 opens the first collector hole 31*c* according to the pressure increment in the heat-generating chamber 10, thereby carrying out the capacity reduction. Note that the pressure increment results from the heat generated by the silicone oil. Whilst, the bimetal type flap valve 35 opens the first supply hole 31*d* according to the temperature decrement of the silicone oil, thereby carrying out the capacity enlargement.

Unless otherwise specified, the viscous heater of the Ninth Preferred Embodiment can operate and produce advantages in the same manner as the First Preferred Embodiment.

Tenth Preferred Embodiment

Figure 32:
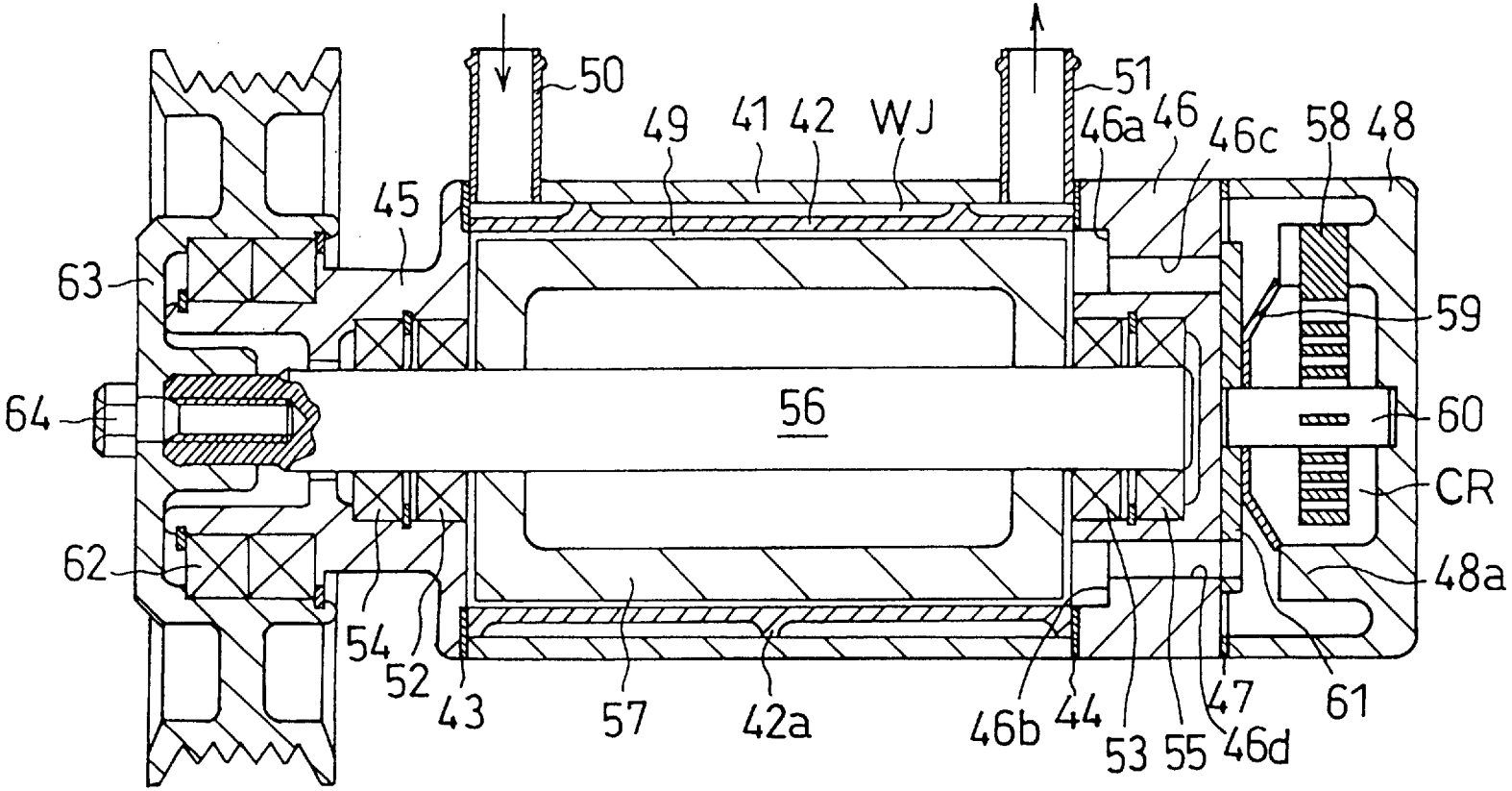
FIG. 32 is a vertical cross-sectional view of a variable capacity type viscous heater of a Tenth Preferred Embodiment.

As illustrated in FIG. 32, the variable capacity type viscous heater of the Tenth Preferred Embodiment employs a cylinder-shaped rotor 57.

Specifically, in the viscous heater, a substantially cylinder-shaped cylinder block 42 is press-fitted into a cylinder-shaped central housing 41. At a front of the central housing 41 and the cylinder block 42, a front housing 45 is bonded by way of a gasket 43. At a rear of the central housing 41 and the cylinder block 42, a rear plate 46 is bonded by way of a gasket 44. The rear plate 46 is further bonded to a rear housing 48 by way of a gasket 47. In the cylinder block 42, a heat-generating chamber 49 is formed. On an outer peripheral surface of the cylinder block 42, a rib 42*a* is protruded in a spiral manner. The rib 42*a* is brought into contact with an inner peripheral surface of the central housing 41 so that it forms a spiral-shaped water jacket WJ. Note that the water jacket WJ works as the radiator chamber. On an outer peripheral surface of the central housing 41, a water inlet port 50 is protruded at a front end, and a water outlet port 51 is protruded at a rear end. Note that the water inlet port 50 and the water outlet port 51 are disposed within an identical outer peripheral surface of the central housing 41. The water inlet port 50 takes in circulating water, working as the circulating fluid, from an external heating circuit (not shown). The water outlet port 51 delivers the circulating water out to the heating circuit. The water inlet port 50 and the water outlet port 51 are communicated with the water jacket WJ.

Further, a pulley 63 is installed to the front housing 45 by way of a bearing apparatus 62. The pulley 63 is fastened to a driving shaft 56 by a bolt 64. The driving shaft 56 is held rotatably in the front housing 45 and the rear plate 46 by way of shaft-sealing apparatuses 52, 53 and bearing apparatuses 54, 55. The driving shaft 56 is further press-fitted into a rotor 57 which has a cylinder-shaped outer peripheral surface. The rotor 57 can thus rotate in the heat-generating chamber 49.

Furthermore, in a front-end surface of the rear plate 46, a collector groove 46*a* and a supply groove 46*b* are formed so as to extend to an outer peripheral region of the heat-generating chamber 49. Note that the supply groove 46*b* works as the distributor passage. At an inner position with respect to the collector groove 46*a*, a first collector hole 46*c* is drilled through to a rear-end surface of the rear plate 46. At an inner position with respect to the supply groove 46*b*, a first supply hole 46*d* is drilled through to a rear-end surface of the rear plate 46. In addition, in the rear housing 48, a control chamber CR is formed so that it can be communicated with the first collector hole 46*c* and the first supply hole 46*d*. In the control chamber CR, a rib 48*a* is protruded as a ring-like shape. In the rib 48*a*, similarly to the First Preferred Embodiment, a rotary valve 61 is disposed. The rotary valve 61 is engaged with a bimetal spiral spring 58, and is pressed by a coned disk spring 59. The rotary valve 61 is further installed to a valve shaft 60 so that it can be rotated by the valve shaft 60. Moreover, in the rotary valve 61, similarly to those of the First Preferred Embodiment, etc., a second collector hole and a second supply hole are drilled through.

In the thus constructed viscous heater, the heat is generated almost on a side of the outer peripheral surface of the rotor 57. On the other hand, the silicone oil is collected from an outer-peripheral side of the heat-generating chamber 49, and is supplied to an outer-peripheral side of the heat-generating chamber 49.

Unless otherwise specified, the viscous heater of the Tenth Preferred Embodiment can operate and produce advantages in the same manner as the First Preferred Embodiment, etc.

Eleventh Preferred Embodiment

Figure 33:
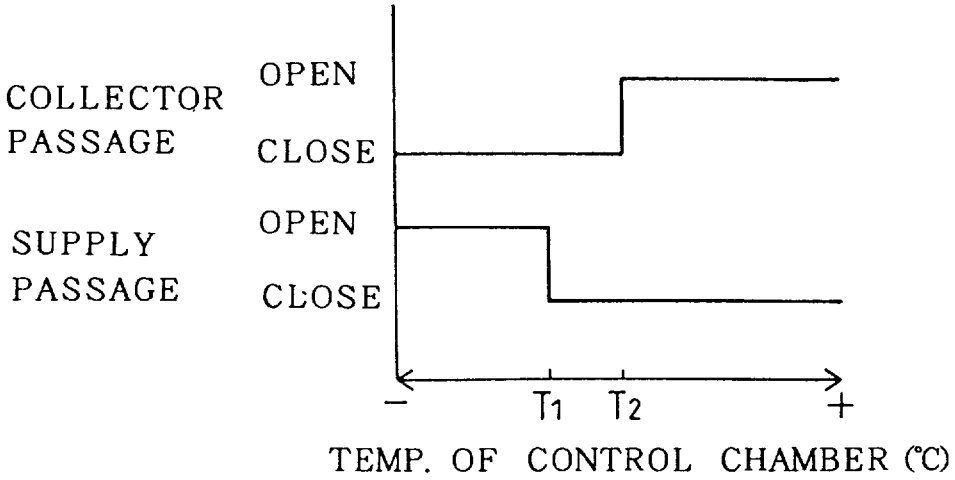
FIG. 33 is concerned with a variable capacity type viscous heater of an Eleventh Preferred Embodiment, and is a timing chart which illustrates the relationship between the opening and closing of a collector passage and a supply passage and the temperature of a control chamber.

The variable capacity type viscous heater of the Eleventh Preferred Embodiment opens and closes a first collector hole and a first supply hole by a bimetal type flap valve. For instance, as illustrated in FIG. 33, when a temperature of the silicone oil, held in the control chamber CR, is $-T_1$ ° C., the first collector hole, etc., are closed in the control chamber CR, and the first supply hole, etc., are opened into the control chamber CR. Moreover, when a temperature of the silicone oil, held in the control chamber CR, is in a range of from $T_1$ to $T_2$ ° C., the first collector hole, etc., are kept being closed in the control chamber CR, and the first supply hole, etc., are closed in the control chamber CR. Additionally, when a temperature of the silicone oil, held in the control chamber CR, is $+T_2$ ° C., the first collector hole, etc., are opened into the control chamber CR, and the first supply hole, etc., are kept being closed in the control chamber CR.

Except that the silicone oil is little flowed in the collecting operation, and that the silicone oil cannot be smoothly collected relatively, the viscous heater of the Eleventh Preferred Embodiment can operate and produce advantages in the same manner as the First Preferred Embodiment.

Twelfth Preferred Embodiment

Figure 34:
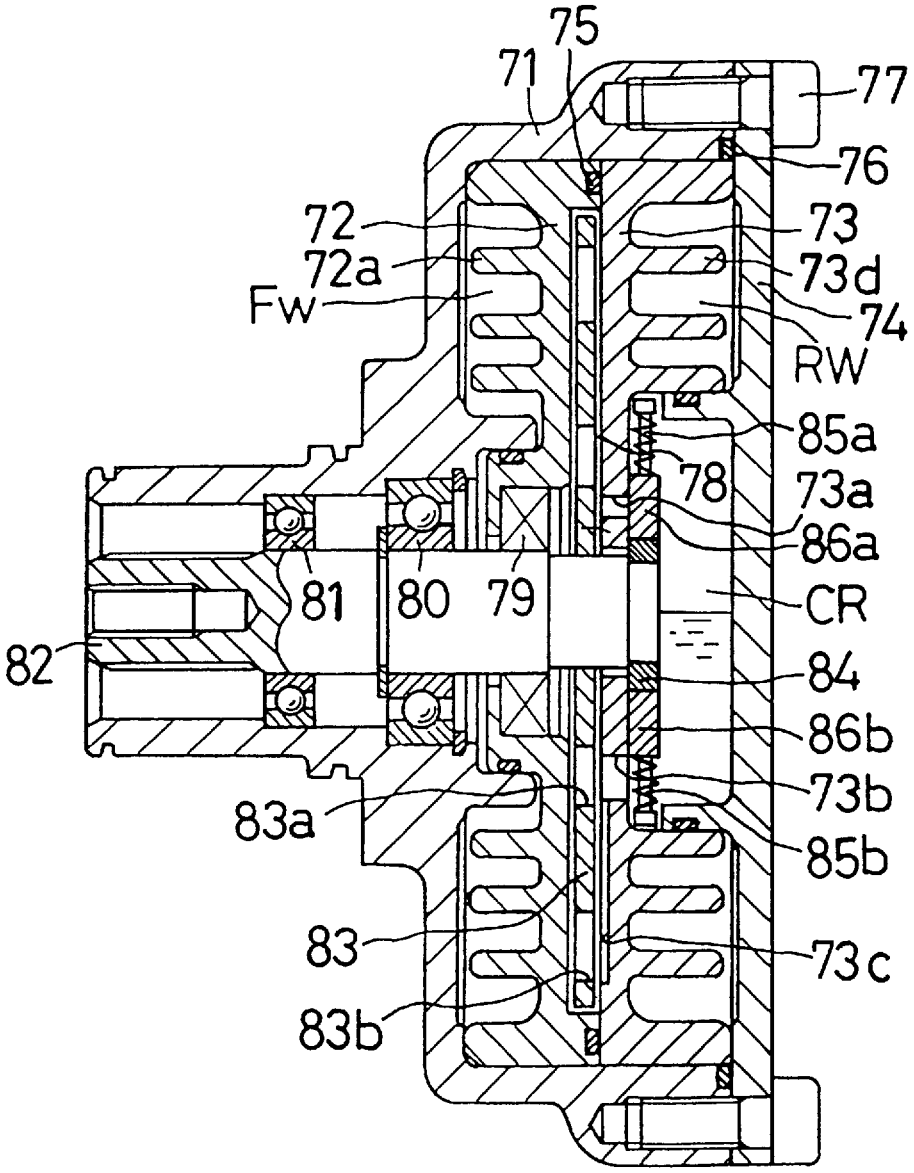
FIG. 34 is a vertical cross-sectional view of a variable capacity type viscous heater of a Twelfth Preferred Embodiment.

As illustrated in FIG. 34, in the variable capacity type viscous heater, a front plate 72 and a rear plate 73 are superimposed by way of an O-ring 75 disposed therebetween, and are accommodated in a front housing body 71. The front housing body 71 is fastened to a rear housing body 74 by a plurality of through bolts 77 so that it is closed by the rear housing body 74 with an O-ring 76 disposed therebetween.

In a rear-end surface of the front plate 72, a concavity is dented so that it forms a heat-generating chamber 78 together with a flat front-end surface of the rear plate 73. In the rear plate 73, a collector hole 73a is drilled through to a rear-end surface thereof so that it is communicated with an upper central region of the heat-generating chamber 78. Note that the collector hole 73*a* works as the collector passage. In the rear plate 73, a supply hole 73*b* is also drilled through to a rear-end surface thereof, and is disposed on an outside below the collector hole 73*a*. Note that the supply hole 73*b* works as the supply passage. A supply groove 73*c* is further extended from the supply hole 73*b* to a lower-side outer region of the heat-generating chamber 78. Note that the supply groove 73*c* works as the distributor passage.

Further, on an outer peripheral side of the front surface of the front plate 72, arc-shaped fins 72*a* are protruded forwardly. The front plate 72 thus forms a front water jacket FW together with an outer-peripheral-side inner surface of the front housing body 71. Note that the front water jacket FW works as the front radiator chamber which neighbors in front of the heat-generating chamber 78. Whilst, on an outer peripheral side of the rear surface of the rear plate 72 as well, arc-shaped fins 73*d* are protruded rearwardly. The rear plate 73 thus forms a rear water jacket RW together with an outer-peripheral-side inner surface of the rear housing body 74. Note that the rear water jacket FW works as the rear radiator chamber which neighbors in rear of the heat-generating chamber 78. In addition, an inner peripheral side of the rear surface of the rear plate 73 and an inner peripheral side of the inner surface of the rear housing body 74 form a control chamber CR which can be communicated with the collector hole 73*a* and the supply hole 73*b*.

Furthermore, on an outer peripheral surface of the front housing 71, a water inlet port (not shown) and a water outlet port (not shown) are formed next to each other. The water inlet port and the water outlet port are communicated with the front water jacket FW and the rear water jacket RW.

Moreover, in the front plate 72, a shaft-sealing apparatus 79 is disposed next to the heat-generating chamber 78. In the front housing body 71, bearing apparatuses 80, 81 are disposed. Accordingly, a driving shaft 82 is held rotatably in the front housing body 71 and the front plate 72 by way of the shaft-sealing apparatus 79 and the bearing apparatuses 80, 81. At a rear portion of the driving shaft 82, a flat plate-shaped rotor 83 is press-fitted so that it can rotate in the heat-generating chamber 78. In an inner peripheral region of the rotor 83, a plurality of central apertures 83*a* are drilled through so that they are communicated with the heat-generating chamber 78 longitudinally. In an outer peripheral region of the rotor 83, a plurality of through holes 83*b* are drilled through so as to enhance the effect of shearing a silicone oil later described. The silicone oil is interposed in the space between the wall surface of the heat-generating chamber 78 and the outer surface of the rotor 83, and in the control chamber CR. Note that the silicone oil works as the viscous fluid.

Figure 35:
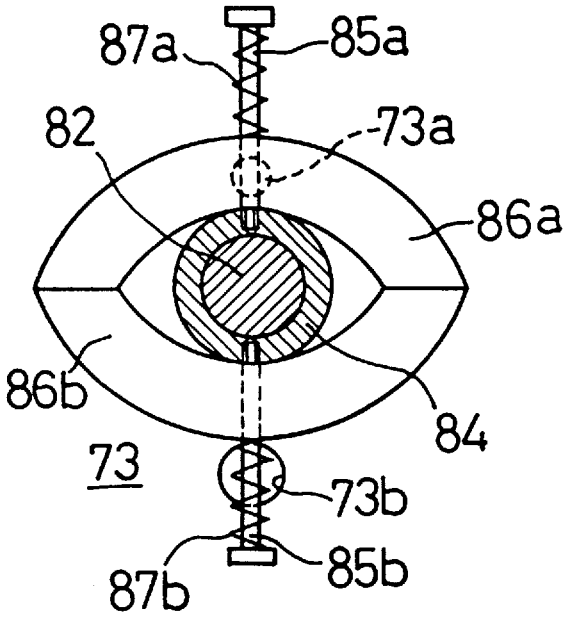
FIG. 35 is concerned with the variable capacity type viscous heater of the Twelfth Preferred Embodiment, and is a cross-sectional view of major portions thereof in the low-revolving-speed operation.
Figure 36:
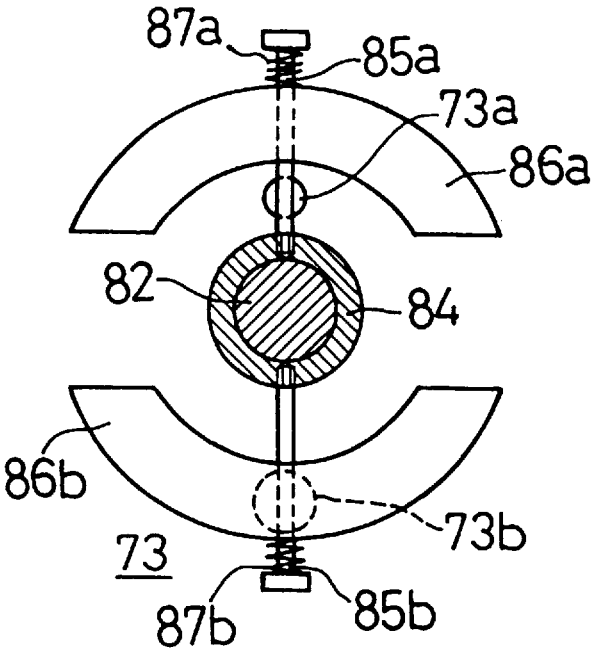
FIG. 36 is concerned with the variable capacity type viscous heater of the Twelfth Preferred Embodiment, and is a cross-sectional view of major portions thereof in the high-revolving-speed operation.

As illustrated in FIGS. 35 and 36, a fixture ring 84 is fixed at a rear end of the driving shaft 82 in the control chamber CR. Further, the fixture ring 84 is fastened to guide pins 85*a*, 85*b* which can extend in a diametric direction. Furthermore, arc-shaped adjusting valves 86*a*, 86*b* are assembled with the guide pins 85*a*, 85*b* in a manner being movable in a diametric direction but being inhibited from rotating, because the guide pins 85*a*, 85*b* are formed as a square shape in cross-section. Moreover, the adjusting valves 86*a*, 86*b* are always urged by compression springs 87*a*, 87*b* which are disposed on a head side of the guide pins 85*a*, 85*b*. Unless otherwise specified, the Twelfth Preferred Embodiment has the same arrangements as those the First Preferred Embodiment, etc.

Figure 37:
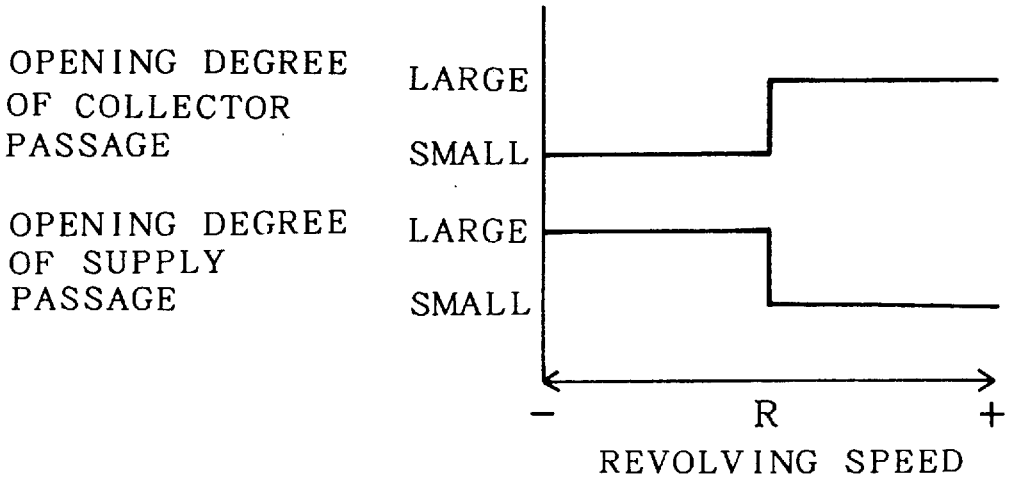
FIG. 37 is concerned with the variable capacity type viscous heater of the Twelfth Preferred Embodiment, and is a timing chart which illustrates the relationship between the magnitude of the opening degree of a collector passage and a supply passage and the revolving speed.

In the viscous heater, when a revolving speed of the driving shaft 82 is low: namely; when it is designated at a revolving speed of −R in FIG. 37, the adjusting valves 86*a*, 86*b* yield to the urging force of the compression springs 87*a*, 87*b* so that they are placed on a side of the driving shaft 82 as illustrated in FIG. 35. Accordingly, an opening degree of the collector hole 73*a* is small on a side of the control chamber CR, but an opening degree of the supply hole 73*b* is large on a side of the control chamber CR. Consequently, the collection of the silicone oil into the control chamber CR terminates virtually, but the supply of the silicone oil into the heat-generating chamber 78 continues virtually. All in all, the heat generation is increased in the space between the wall surface of the heat-generating chamber 78 and the outer surface of the rotor 83 (i.e., capacity enlargement), and thereby the heating is intensified.

On the other hand, when a revolving speed of the driving shaft 82 is high: namely; when it is designated at a revolving speed of +R in FIG. 37, the adjusting valves 86*a*, 86*b* are subjected to a large centrifugal force so that they are separated away from a side of the driving shaft 82 as illustrated in FIG. 36. Accordingly, an opening degree of the collector hole 73*a* is large on a side of the control chamber CR, but an opening degree of the supply hole 73*b* is small on a side of the control chamber CR. Consequently, the supply of the silicone oil into the heat-generating chamber 78 terminates virtually, but the collection of the silicone oil into the control chamber CR continues virtually. All in all, the silicone oil, held in the heat-generating chamber 78, is inhibited from elevating the temperature, and is eventually inhibited from deteriorating. In addition, the heat generation can be maintained even after the viscous heater is operated for a long period of time.

Thirteenth Preferred Embodiment

Figure 38:
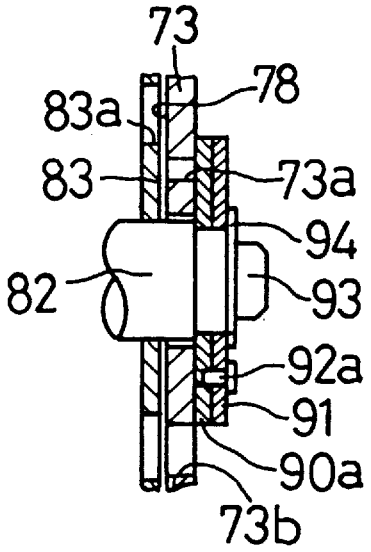
FIG. 38 is a vertical cross-sectional view of major portions of a variable capacity type viscous heater of a Thirteenth Preferred Embodiment.
Figure 39:
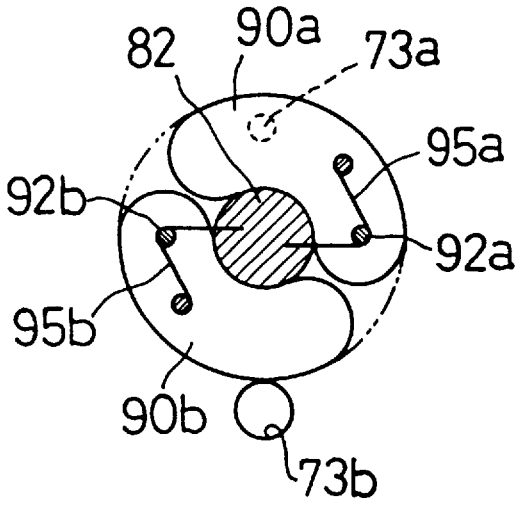
FIG. 39 is concerned with the variable capacity type viscous heater of the Thirteenth Preferred Embodiment, and is a cross-sectional view of major portions thereof in the low-revolving-speed operation.
Figure 40:
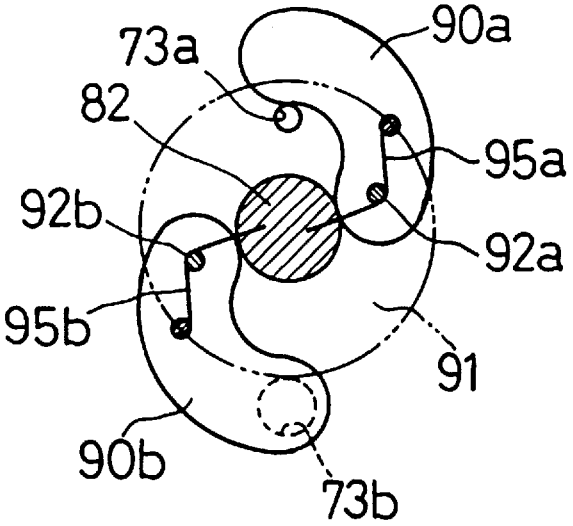
FIG. 40 is concerned with the variable capacity type viscous heater of the Thirteenth Preferred Embodiment, and is a cross-sectional view of major portions thereof in the high-revolving-speed operation.

As illustrated in FIGS. 38 through 40, the variable capacity type viscous heater of the Thirteenth Preferred Embodiment employs arc-shaped adjusting valves 90*a*, 90*b*. Specifically, as illustrated in FIG. 38, a fixture ring 91 is fixed to a rear end of a driving shaft 82 by a bolt 93 by way of a washer 94 in a control chamber CR. The adjusting valves 90*a*, 90*b* are then disposed under the fixture ring 91 swingably by swinging pins 92*a*, 92*b* which extend in an axial direction. As illustrated in FIGS. 39 and 40, the adjusting valves 90*a*, 90*b* are provided with torsional coil springs 95*a*, 95*b* which are disposed between the driving shaft 82 and stoppers formed on the adjusting valves 90*a*, 90*b*. Thus, the torsional coil springs 95*a*, 95*b* always urge the adjusting valves 90*a*, 90*b* toward the driving shaft 82. Unless otherwise specified, the Thirteenth Preferred Embodiment has the same arrangements as those of the Twelfth Preferred Embodiment.

The viscous heater of the Thirteenth Preferred Embodiment can operate and produce advantages in the same manner as the Twelfth Preferred Embodiment.

Note that, in the viscous heater of the Twelfth or Thirteenth Preferred Embodiment, the collector hole 73*a* and the supply hole 73*b* are not opened or closed completely by the above-described adjusting valves 86*a*, 86*b* or by the adjusting valves 90*a*, 90*b*. Namely, the collector hole 73*a* and the supply hole 73*b* are opened or closed intermittently in accordance with an opening or closing angle with respect to one revolution of the driving shaft 82, for instance, in accordance with the extent of the opening degree as set forth in the Twelfth or Thirteenth Preferred Embodiment. However, taking the viscosity of the silicone oil, which is subjected to the collecting and supplying operations, into consideration, such an intermittent opening or closing can be effective as well, because the supplying amount or the collecting amount can be varied in accordance with how far the flowing of the silicone oil is continued or discontinued.

Fourteenth Preferred Embodiment

Figure 41:
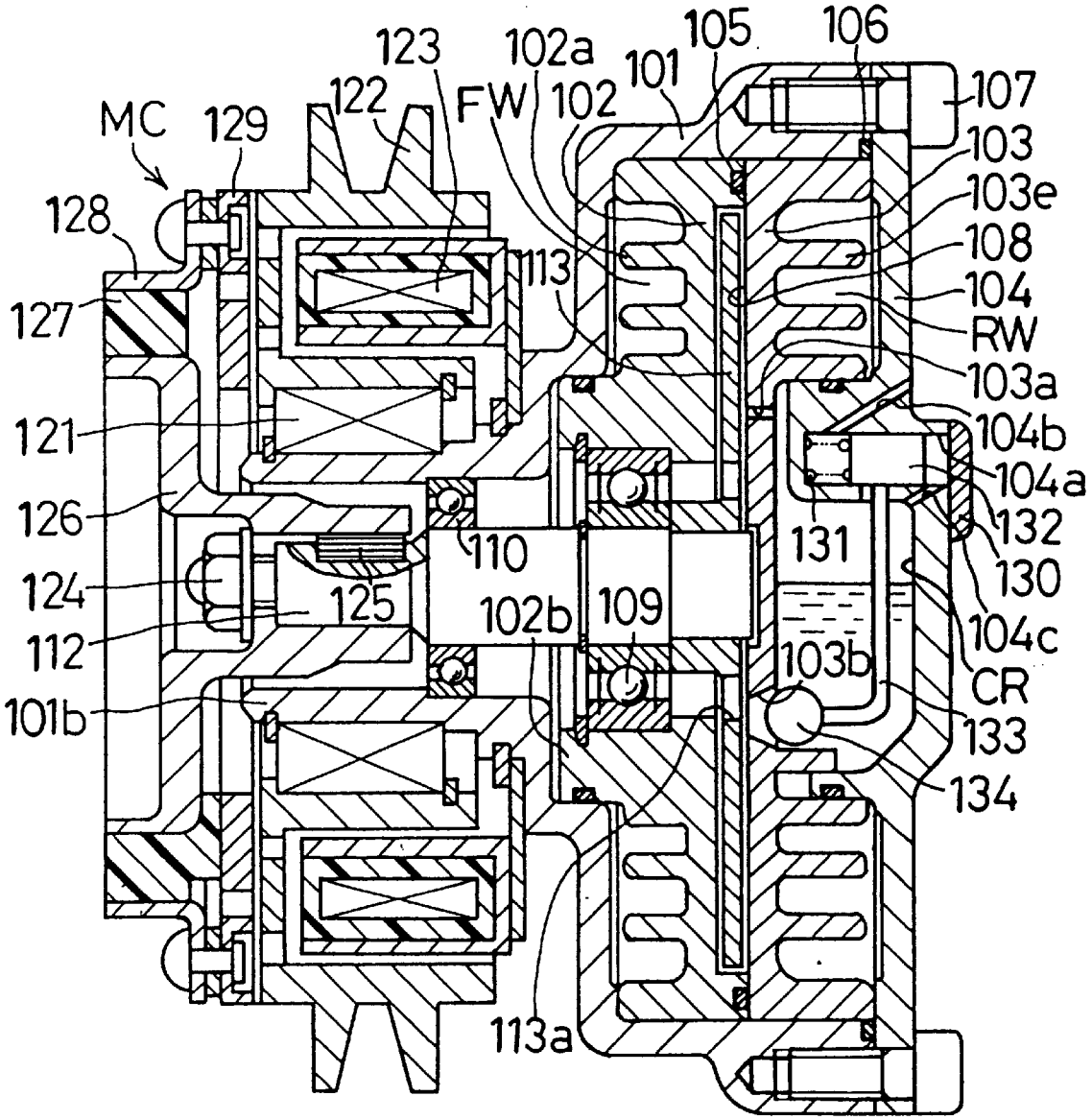
FIG. 41 is concerned with a variable capacity type viscous heater of a Fourteenth Preferred Embodiment, and is a cross-sectional view of major portions thereof in the low-revolving-speed operation.

As illustrated in FIG. 41, in the variable capacity type viscous heater, a front plate 102 and a rear plate 103 are superimposed by way of an O-ring 105 disposed therebetween, and are accommodated in a front housing body 101. The front housing body 101 is fastened to a rear housing body 104 by a plurality of through bolts 107 so that it is closed by the rear housing body 104 with an O-ring 106 disposed therebetween.

In a rear-end surface of the front plate 102, a concavity is dented so that it forms a heat-generating chamber 108 together with a flat front-end surface of the rear plate 103. In the rear plate 103, a collector hole 103*a* and a supply hole 103*b* are drilled through to a rear-end surface thereof. The collector hole 103*a* is communicated with an upper central region of the heat-generating chamber 108. The supply hole 103*b* is communicated with a lower central region of the heat-generating chamber 108. Note that the supply hole 103*b* is tapered from narrow to wide toward a side of a control chamber CR so that a seating surface is formed.

Further, on an outer peripheral side of the front surface of the front plate 102, a plurality of arc-shaped fins 102*a* are protruded forwardly. The front plate 102 thus forms a front water jacket FW together with an outer-peripheral-side inner surface of the front housing body 101. Note that the front water jacket FW works as the front radiator chamber which neighbors in front of the heat-generating chamber 108. Whilst, on an outer peripheral side of the rear surface of the rear plate 102 as well, a plurality of arc-shaped fins 103*e* are protruded rearwardly. The rear plate 103 thus forms a rear water jacket RW together with an outer-peripheral-side inner surface of the rear housing body 104. Note that the rear water jacket FW works as the rear radiator chamber which neighbors in rear of the heat-generating chamber 108. In addition, an inner peripheral side of the rear surface of the rear plate 103 and an inner peripheral side of the inner surface of the rear housing body 104 form a control chamber CR which is communicated with the collector hole 103*a* and the supply hole 103*b*. On an outer peripheral surface of the front housing 101, a water inlet port (not shown) and a water outlet port (not shown) are formed next to each other. The water inlet port and the water outlet port are communicated with the front water jacket FW and the rear water jacket RW.

Furthermore, the front plate 102 is provided with a boss 102*b*. In the boss 102*b*, a bearing apparatus 109 is disposed which includes a built-in shaft-sealing apparatus. The front housing body 101 is provided with a boss 101*b*. In the boss 101*b*, a bearing apparatus 110 is disposed. Accordingly, a driving shaft 112 is held rotatably by these bearing apparatuses 109, 110. An electromagnetic clutch MC is further disposed in the boss 101*b* of the front housing body 101. In the electromagnetic clutch MC, a pulley 122 is held rotatably to the boss 101*b* by way of a bearing apparatus 121, and an exciting coil 123 is disposed so as to be positioned in the pulley 122. A hub 126 is fixed to the driving shaft 112 by screwing a bolt 124 into the driving shaft 112 and press-fitting a key 125 thereinto. The hub 125 is further fixed to an armature 129 by way of a rubber member 127 and a flange 128. The pulley 122 is rotated by an engine (not shown) of vehicles by way of a belt.

Moreover, at a rear portion of the driving shaft 112, a flat plate-shaped rotor 113 is press-fitted so that it can rotate in the heat-generating chamber 108. In an inner peripheral region of the rotor 113, a plurality of central apertures 113*a* are drilled through so that they are communicated with the heat-generating chamber 108 longitudinally. A silicone oil is interposed in the space between the wall surface of the heat-generating chamber 108 and the outer surface of the rotor 113, and in the control chamber CR. Note that the silicone oil works as the viscous fluid.

Figure 42:
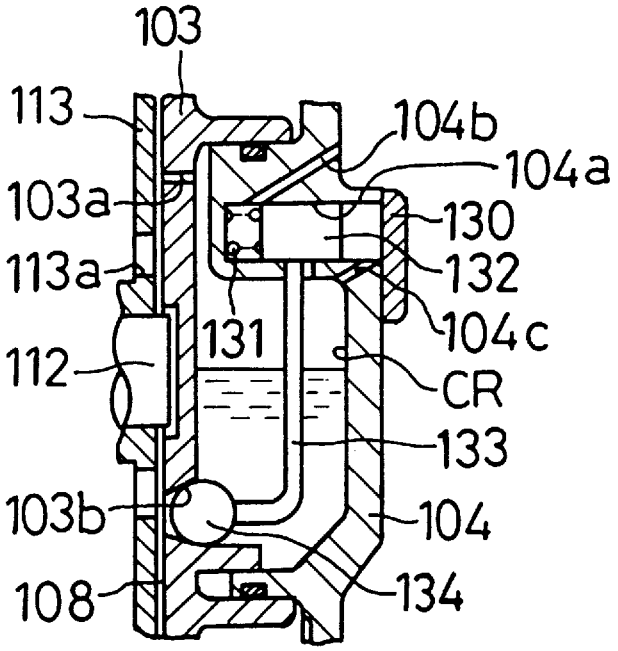
FIG. 42 is concerned with the variable capacity type viscous heater of the Fourteenth Preferred Embodiment, and is a cross-sectional view of major portions thereof in the high-revolving-speed operation.

In addition, as best shown in FIG. 42, the rear housing body 104 is provided with a swollen portion which is protruded into the control chamber CR. In the swollen portion, a spool chamber 104*a* is formed. The spool chamber 104*a* is closed by a lid member 130. The spool chamber 104*a* thus closed by the lid member 130 can extend longitudinally. In the spool chamber 104*a*, a spool 132 is disposed. A compression spring 131 is further interposed between the spool 132 and an opposite end surface of the spool chamber 104*a* on a side of the heat-generating chamber 108. The spool 132 thus interposed by the compression spring 131 is accommodated in the spool chamber 104*a* slidably in longitudinal directions. The spool chamber 104*a* is communicated with the atmosphere on one of the opposite ends on a side of the heat-generating chamber 108 by an atmosphere hole 104*b* which penetrates through the swollen member. The spool chamber 104 is further communicated with the control chamber CR on another one of the opposite ends by a control hole 104*c* which penetrates through the swollen member. On a side surface of the spool 132, a rod 133 is fixed. The rod 133 is protruded from the spool chamber 104*a* so as to extend into the control chamber CR and toward the supply hole 103b. At a leading end of the rod 133, a sphere 134 is fixed so that it can open and close the supply hole 103*b*. The spool 132, etc., thus constitute the spool valve. Unless otherwise specified, the Fourteenth Preferred Embodiment has the same arrangements as those the First Preferred Embodiment, etc.

In the viscous heater, when a revolving speed of the driving shaft 112 is so low that the heat generation is small, the gaseous pressure is relatively low in the control chamber CR, and the silicone oil is contracted. Accordingly, the pressure, which is introduced into the spool chamber 104*a* from the control chamber CR by way of the control hole 104*c*, yields to the summed force, which results from the urging force of the compression spring 131 and the atmospheric pressure introduced through the atmosphere hole 104*b*. Consequently, the spool 132 retracts so as to get way from the heat-generating chamber 108. As a result, an opening degree of the supply hole 103*b* is enlarged on a side of the control chamber CR by the sphere 134 by way of the rod 133, and the supply of the silicone oil, held in the control chamber CR, is started, or the supplying amount is increased. All in all, the heat generation is increased in the space between the wall surface of the heat-generating chamber 108 and the outer surface of the rotor 113 (i.e., capacity enlargement), and thereby the heating is intensified.

On the other hand, when a revolving speed of the driving shaft 112 is so high that the heat generation is large, the gaseous pressure is relatively high in the control chamber CR, and the silicone oil is expanded. Accordingly, as illustrated in FIG. 42, the pressure, which is introduced into the spool chamber 104*a* from the control chamber CR by way of the control hole 104*c*, overcomes the summed force, which results from the urging force of the compression spring 131 and the atmospheric pressure introduced through the atmosphere hole 104*b*. Consequently, the spool 132 advances so as to approach the heat-generating chamber 108. As a result, an opening degree of the supply hole 103*b* is reduced on a side of the control chamber CR by the sphere 134 by way of the rod 133, and the supply of the silicone oil, held in the control chamber CR, is terminated, or the supplying amount is decreased. All in all, the silicone oil, held in the heat-generating chamber 108, is inhibited from elevating the temperature, and is eventually inhibited from deteriorating. In addition, the heat generation can be maintained even after the viscous heater is operated for a long period of time. Unless otherwise specified, the viscous heater of the Fourteenth Preferred Embodiment can operate and produce advantages in the same manner as the First Preferred Embodiment, etc.

Figure 43:
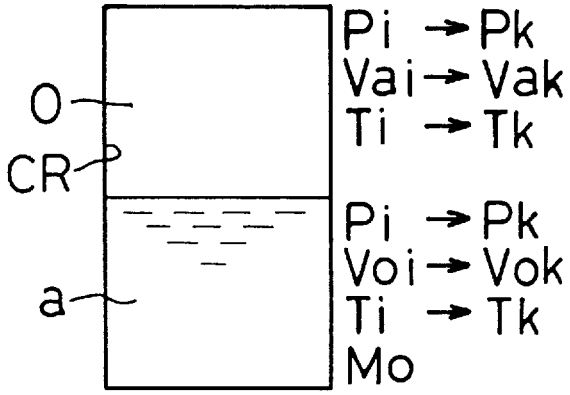
Figure 43:
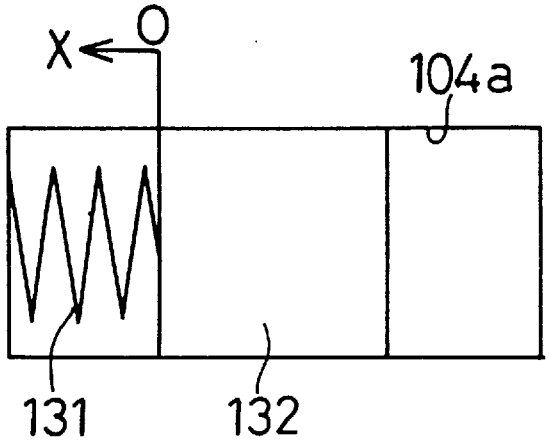

As illustrated in FIG. 43(A), in operation, the viscous heater of the Fourteenth Preferred Embodiment is in a stationary state where the collected amount of the silicone oil, collected by way of the collector hole 103*a*, is equal to the supply amount of the silicone oil, supplied by way of the supply hole 103*b*. Let us assume that a storage amount of the silicone oil in initial operation is equal to a storage amount thereof in operation, the mechanics in the control chamber CR can be investigated and determined schematically as hereinafter designated. Symbols are herein specified as follows: P designates a pressure; V designates a volume; T designates an absolute temperature; M designates a mass; $\alpha$ designates a solubility of air into the silicone oil; $\rho$ designates a density of the silicone oil; and $\beta$ designates a thermal expansion coefficient of the silicone oil. Subscripts added to the symbols are meant as follows: i designates the initial operation; k designates the operation; a designates "in air"; and o designates "in the silicone oil".

In the initial operation, let us assume that $T_i$ in the air is equal to $T_i$ in the silicone oil. The air is dissolved into the silicone oil in an amount of $\alpha M_o/\rho_{ai}$. Accordingly, the total volume of the air in the control chamber CR is:

$$V=V_{ai}+\alpha M_o/\rho_{ai}.$$

In the operation, let us assume that $T_k$ in the air is equal to $T_k$ in the silicone oil. The volume of the air is reduced by the expansion of the silicone oil in an amount of $V_{oi}\beta(T_k-T_i)$. Consequently, a volume $V_{ak}$ of the air in the control chamber CR is:

$$V_{ak}=V_{ai}-V_{oi}\beta(T_k-T_i)+\alpha M_o/\rho_{ak}.$$

Here,in accordance with the Boyle-Charle's law, the following equation is established:

$$P_i(V_{ai}+\alpha M_o/\rho_{ai})/T_i=P_k\{V_{ai}-V_{oi}\beta(T_k-T_i)+\alpha M_o/\rho_{ak}\}/T_k.$$

As a result, in the operation, a pressure $P_k$ in the control chamber CR is:

$$P_k=T_kP_i\{V_{ai}+\alpha M_o/\rho_{ai}\}/T_i\{V_{ai}-V_{oi}\beta(T_k-T_i)+\alpha M_o/\rho_{ak}\}.$$

It is understood that, in this equation, $P_k>P_i$ because $T_k>T_i$. In other words, when $P_i$ is set virtually equal to the atmospheric pressure, the following relationship is established:

$P_k$ in the control chamber CR during low-speed operation$<P_k$ in the control chamber CR during high-speed operation.

In addition, as illustrated in FIG. 43(B), the mechanics in the spool chamber 104 can be investigated and determined schematically as hereinafter designated. In this investigation, the symbols and subscripts, which are the same as above, are used. In addition, A designates a cross-sectional area of the spool 132, K designates a spring constant of the compression coil spring 131, and x designates a displacement of the spool 132 from 0 at which the spool 132 is not subjected to the urging force of the compression spring 131. Note that, however, $\Delta x=0$ when $P_k=P_a$. As a result, a position of the spool 132 can be determined so as to establish the following equation:

$$P_aA+K\Delta x=P_kA.$$

All in all, it is apparent that, when manufacturing the variable capacity type viscous heater of the Fourteenth Preferred Embodiment, these relationships can be taken into account.

Note that, in the First through Fourteenth Preferred Embodiments, it is possible to always open the collector passage, and to open and close the supply passage in accordance with the required heating capacity.

Further, in stead of the bimetal employed in the above-described preferred embodiments, a shape memory alloy, a thermoactuator, or the like, can be employed as the actuating means for the first and second valve means. Note that the actuating means itself can work as the valve means.

Furthermore, the heating can be carried out optimally in accordance with external environments, such as a water temperature in a radiator, a revolving speed of the engine or the viscous heater, and a passenger compartment, when the following arrangement is employed: namely; the rotary valve can be connected to a motor, and the motor can be controlled by an external input so as to open and close the supply passage; or an electromagnetic valve can be employed as the first valve means, the second valve means and/or the third valve means, and the electromagnetic valve can be controlled by an external input so as to open and close the collector passage and/or the supply passage.

Moreover, when the first valve means, the second valve means and/or the third valve means are controlled independently, it is possible to finely carry out the temperature control, because the collector passage, the supply passage and/or the gas passage can be opened and closed by, for instance, independent external inputs.

In addition to the coaxial type screw pump whose driving shaft is coaxial with the driving shaft of the variable capacity type viscous heater of the Third Preferred Embodiment, the variable capacity type viscous heater can employ an off-set type screw pump whose driving shaft is off-set to the driving shaft of the viscous heater as the compulsory supplying means. In addition to the screw pumps, the viscous heater can employ a gear pump, a trochoid pump, a centrifugal pump, or the like. When the driving shaft of these pumps are off-set to the driving shaft of the viscous heater, the pumps can be provided with another driving source.

We claim:

1. A variable capacity type viscous heater, comprising:

a housing in which a heat-generating chamber and a radiator chamber are formed, the radiator chamber neighboring the heat-generating chamber, and circulating a circulating fluid therein;

a driving shaft held rotatably in said housing by way of a bearing apparatus;

a rotor disposed in said heat-generating chamber coupled to said driving shaft for rotation therewith; and a viscous fluid interposed in a space between a wall surface of said heat-generating chamber and an outer surface of said rotor, rotation of said rotor causing heat to be generated in said viscous fluid;

wherein said housing is provided with a collector passage formed therein, and communicated with said heat-generating chamber, an openable and closeable supply passage formed therein, communicated with said heat-generating chamber, a control chamber formed therein, and communicated with the collector passage and the supply passage, and a gas passage which communicates said heat-generating chamber with said control chamber; whereby capacity reduction is carried out by collecting said viscous fluid, held said heat-generating chamber, by way of the collector passage; and whereby capacity enlargement is carried out by supplying said viscous fluid, held in said control chamber, by way of the opened supply passage.

2. A variable capacity type viscous heater according to claim 1, wherein said supply passage is provided with second valve means which opens and closes said supply passage.

3. A variable capacity type viscous heater according to claim 2, wherein said second valve means opens or closes a control-chamber-side opening of said supply passage by means of a bimetal which is deformed and actuated by temperature variation of said viscous fluid.

4. A variable capacity type viscous heater according to claim 1, wherein said gas passage is openable and closeable.

5. A variable capacity type viscous heater according to claim 4, wherein said gas passage is provided with a third valve means which opens and closes said gas passage.

6. A variable capacity type viscous heater according to claim 5, wherein said third valve means is a rotary valve which is disposed in said control chamber, and which rotates to open or close a control-chamber-side opening of said gas passage.

7. A variable capacity type viscous heater, comprising:

a housing in which a heat-generating chamber and a radiator chamber are formed, the radiator chamber neighboring the heat-generating chamber, and means for enabling the circulation of a circulating fluid through the radiator chamber;

a driving shaft rotatably supported in said housing by way of a bearing apparatus;

a rotor disposed in said heat-generating chamber for rotation by said driving shaft; and a viscous fluid interposed in a space between a wall surface of said heat-generating chamber and an outer surface of said rotor, and caused to generate heat by rotation of said rotor;

wherein said housing is provided with an openable and closeable collector passage formed therein, communicated with said heat-generating chamber, a supply passage formed therein, and communicated with said heat-generating chamber, and a control chamber formed therein, and communicated with the collector passage and the supply passage; whereby capacity reduction is carried out by collecting said viscous fluid from said heat-generating chamber by way of the opened collector passage; and whereby capacity enlargement is carried out by supplying said viscous fluid from said control chamber by way of the supply passage.

8. A variable capacity type viscous heater according to claim 1 or 7, wherein said collector passage has a control-chamber-side opening which is disposed on an upper side with respect to a liquid level of said viscous fluid, held in said control chamber, and that said supply passage thereof has a control-chamber-side opening which is disposed on a lower side with respect to the liquid level of said viscous fluid, held in said control chamber.

9. A variable capacity type viscous heater according to claim 1 or 7, wherein said supply passage has a larger communication area than that of said collector passage.

10. A variable capacity type viscous heater according to claim 1 or 7, wherein said supply passage is provided with compulsory supplying means for compulsorily supplying said viscous fluid, held in said control chamber, into said heat-generating chamber.

11. A variable capacity type viscous heater according to claim 1 or 7, wherein at least a forward-side peripheral portion, with respect to the rotary direction of said rotor, in a heat-generating-chamber-side opening of said collector passage is formed so that gas, held in said heat-generating chamber, is likely to be taken in into said control chamber by said rotating rotor.

12. A variable capacity type viscous heater according to claim 11, wherein at least said forward-side peripheral portion, with respect to the rotary direction of said rotor, in said heat-generating-chamber-side opening of said collector passage is subjected to chamfering.

13. A variable capacity type viscous heater according to claim 1 or 7, wherein said supply passage has a distributor passage, which extends toward an outer periphery of said rotor, in said heat-generating chamber.

14. A variable capacity type viscous heater according to claim 13, wherein said distributor passage is formed so that said viscous fluid, held in said control chamber, is likely to be taken in into said heat-generating chamber by said rotating rotor.

15. A variable capacity type viscous heater according to claim 14, wherein said distributor passage is a supply groove which is dented in said housing so as to be opened on a heat-generating-chamber side thereof, and which is inclined with respect to a diametric direction of said rotor on a forward side with respect to the rotary direction of said rotor.

16. A variable capacity type viscous heater according to claim 1, wherein said collector passage is provided with first valve means which opens and closes said collector passage.

17. A variable capacity type viscous heater according to claim 16, wherein said first valve means opens or closes a control-chamber-side opening of said collector passage by means of a bimetal which is deformed and actuated by temperature variation of said viscous fluid.

18. A variable capacity type viscous heater according to claim 16, wherein said supply passage is provided with second valve means which opens and closes said supply passage.

19. A variable capacity type viscous heater according to claim 1 or 18, wherein the opening and closing said supply passage and collector passage are provided with a timing where said collector passage is opened when said supply passage is opened.

20. A variable capacity type viscous heater according to claim 19, wherein said first and second valve means are a rotary valve which is disposed in said control chamber, and which rotates to open or close said control-chamber-side openings of said collector passage and supply passage, and the rotary valve opens or closes said control-chamber-side openings of said collector passage and supply passage by means of a single arc-shaped through hole.

21. A variable capacity type viscous heater according to claim 1 or 18, wherein said housing is provided with a gas passage which communicates said heat-generating chamber with said control chamber.

22. A variable capacity type viscous heater according to claim 21, wherein said gas passage communicates an upper side of said heat-generating chamber with an upper side of said control chamber.

23. A variable capacity type viscous heater according to claim 21, wherein said gas passage is openable and closeable.

24. A variable capacity type viscous heater according to claim 23, wherein said gas passage is provided with a third valve means which opens and closes said gas passage.

25. A variable capacity type viscous heater according to claim 24, wherein said third valve means is a rotary valve which is disposed in said control chamber, and which rotates to open or close a control-chamber-side opening of said gas passage.

26. A variable capacity type viscous heater according to claim 25, wherein said control chamber is provided with a bimetal spiral spring disposed therein, and said rotary valve is rotated by displacement of the bimetal spiral spring which depends on temperature variation of said viscous fluid held in said control chamber.

* * * * *

UNITED STATES PATENT AND TRADEMARK OFFICE

CERTIFICATE OF CORRECTION

PATENT NO. : 5,845,608

DATED : Decembe 8,1998

INVENTOR(S) Takashi Ban et al.

It is certified that error appears in the above-identified patent and that said Letters Patent is hereby corrected as shown below:

In column 2, line 66: change "operable" to --openable--;

In column 2, line 67: change "closable" to --closeable--;

In column 3, lines 66: delete "set forth in claim 2";

In column 4 line 15: change "operable" to --openable--;

In column 4, line 47: delete "set forth in claim 2";

In column 5, line 12: change "third" to --this--;

In column 5, line 47: delete "not";

In column 5, line 49: delete the first ",";

In column 5, line 58: delete "set forth in claim 5";

In column 8, line 35: after the word "heater" and before the word "characterized", insert --is--;

In column 9, line 54: delete "set forth in claim 29";

In column 11, line 1: delete ",";

UNITED STATES PATENT AND TRADEMARK OFFICE

CERTIFICATE OF CORRECTION

PATENT NO. : 5,845,608

DATED : December 8,1998

INVENTOR(S) : Takashi Ban et al.

It is certified that error appears in the above-identified patent and that said Letters Patent is hereby corrected as shown below:

In column 20, line 56: after the word "as" and before the word "of", insert --those--;

In column 21, line 39: change "beater" to --heater--.

Signed and Sealed this

First Day of June, 1999

*Attest:*

*Attesting Officer*

Q. TODD DICKINSON

*Acting Commissioner of Patents and Trademarks*

UNITED STATES PATENT AND TRADEMARK OFFICE

CERTIFICATE OF CORRECTION

PATENT NO. : 5,845,608

DATED : December 8, 1998

INVENTOR(S) : Takashi Ban et al.

It is certified that error appears in the above-identified patent and that said Letters Patent is hereby corrected as shown below:

Column 24, line 32: change "30c" to --30ℓ--;

Column 24, line 33: change "30c" to --30ℓ--;

Column 24, line 38: change "30c" to --30ℓ--;

Column 24, line 46: change "30c" to --30ℓ--;

Column 33, line 8: after the word "Here," and before the word "in", insert a space.

Signed and Sealed this

Eighteenth Day of July, 2000

*Attest:*

Q. TODD DICKINSON

*Attesting Officer*

*Director of Patents and Trademarks*